US011389815B2

(12) United States Patent
Sasaki et al.

(10) Patent No.: US 11,389,815 B2
(45) Date of Patent: Jul. 19, 2022

(54) SPOUTING CONTAINER

(71) Applicants: SHISEIDO COMPANY, LTD., Tokyo (JP); YOSHINO KOGYOSHO CO., LTD., Tokyo (JP)

(72) Inventors: Tsuyoshi Sasaki, Tokyo (JP); Hiromichi Saito, Tokyo (JP); Toru Toma, Tokyo (JP)

(73) Assignees: SHISEIDO COMPANY, LTD., Tokyo (JP); YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 17/290,403

(22) PCT Filed: Oct. 31, 2019

(86) PCT No.: PCT/JP2019/042867

§ 371 (c)(1),
(2) Date: Apr. 30, 2021

(87) PCT Pub. No.: WO2020/090993

PCT Pub. Date: May 7, 2020

(65) Prior Publication Data

US 2021/0354156 A1 Nov. 18, 2021

(30) Foreign Application Priority Data

Oct. 31, 2018 (JP) ..... JP2018-205392

(51) Int. Cl.
*B05B 11/00* (2006.01)

(52) U.S. Cl.
CPC ..... *B05B 11/3084* (2013.01); *B05B 11/0038* (2018.08); *B05B 11/00411* (2018.08);
(Continued)

(58) Field of Classification Search
CPC ..... B05B 11/3084; B05B 11/3052; B05B 11/3083; B05B 11/0038; B05B 11/00411; B05B 11/3001; B05B 11/3023
See application file for complete search history.

(56) References Cited

U.S. PATENT DOCUMENTS 5,848,732 A * 12/1998 Brugger ..... B05B 11/3083 222/137
6,464,107 B1 10/2002 Brugger
(Continued)

FOREIGN PATENT DOCUMENTS

JP 2002-522187 A 7/2002
JP 2003-034374 A 2/2003
(Continued)

OTHER PUBLICATIONS

Dec. 3, 2019 International Search Report issued in International Patent Application No. PCT/JP2019/042867.
(Continued)

*Primary Examiner* — Frederick C Nicolas
(74) *Attorney, Agent, or Firm* — Oliff PLC

(57) ABSTRACT

A dispensing container capable of changing the ratio between the amounts of two kinds of contents to be dispensed, includes two container bodies, two pumps including two stems, an adjusting member configured to press the stems and to be rotatable about an axis extending in a substantially vertical direction, and a pressing head configured to, in response to a depressing operation, rotate about an axis extending in a substantially horizontal direction, to thereby depress the stems via the adjusting member. The adjusting member includes a plurality of pressing portions against which the stems are pressed, and when the adjusting member is rotated about the axis, a depressing stroke of the one of the plurality of pressing portions on the side of one of the stems becomes shorter, and a depressing stroke of the other one of the plurality of pressing portions on the side of the other stem becomes longer.

7 Claims, 28 Drawing Sheets

(52) U.S. Cl.
CPC ..... *B05B 11/3001* (2013.01); *B05B 11/3023* (2013.01); *B05B 11/3052* (2013.01); *B05B 11/3083* (2013.01)

(56) References Cited

U.S. PATENT DOCUMENTS

| | | | | |
|---|---|---|---|---|
| 7,222,752 | B2 * | 5/2007 | Ponton | B05B 11/3083 222/134 |
| 7,240,808 | B2 * | 7/2007 | Brugger | B05B 11/3083 222/135 |
| 9,550,199 | B2 * | 1/2017 | Burrowes | B05B 11/3056 |
| 10,583,450 | B2 * | 3/2020 | Brugger | B05B 11/3073 |
| 10,584,023 | B2 * | 3/2020 | Beyda | B67D 3/0064 |
| 2004/0251274 | A1 | 12/2004 | Ponton | |

FOREIGN PATENT DOCUMENTS

| | | | |
|---|---|---|---|
| JP | 3651773 | B2 | 5/2005 |
| JP | 2010-005537 | A | 1/2010 |
| WO | 2012/029272 | A1 | 3/2012 |

OTHER PUBLICATIONS

May 6, 2021 Office Action issued in Taiwanese Patent Application No. 108139581.

* cited by examiner

A-A section

B-B section

C-C section

SPOUTING CONTAINER

CROSS-REFERENCE TO RELATED APPLICATION

This application claims priority to Japanese Patent Application No. 2018-205392, filed on Oct. 31, 2018, the entire contents of which are incorporated herein by reference.

TECHNICAL FIELD

The present disclosure relates to a dispensing container capable of changing the ratio between the amounts of two kinds of contents to be dispensed.

BACKGROUND

As a type of container that contains cosmetic lotions, hair dyes, or the like, a dispensing container that contains two kinds of contents separately and that, when used, mixes the contents before dispensing them has been proposed (refer to, for example, Patent Literature [PTL] 1).

CITATION LIST

Patent Literature

PTL 1: JP 3651773 B2

SUMMARY

Technical Problem

The problem with the dispensing container described in PTL 1, however, is that although it is possible to select whether to dispense equal amounts of the two kinds of contents at the same time or to dispense only one of the contents, it is not possible to dispense the two kinds of contents by changing the ratio between the amounts of the contents to be dispensed. The dispensing container can hardly be used to finely adjust the ratio between the amounts of the two contents to be dispensed in accordance with skin and hair conditions of the user, and there is room for improvement in this respect.

It would be helpful to provide a dispensing container that is capable of changing the ratio between the amounts of two kinds of contents to be dispensed.

Solution to Problem

A dispensing container according to an embodiment of the present disclosure includes:

two container bodies configured to respectively contain two kinds of contents;

two pumps respectively including two protruding stems configured to be depressed in an upwardly urged state, the two pumps being configured to respectively pump the two kinds of contents in the two container bodies upward in response to the two stems being depressed;

an adjusting member configured to directly or indirectly press the two stems and configured to be rotatable about an axis extending in a substantially vertical direction that is located between the two container bodies in a plan view; and a pressing head configured to, in response to a depressing operation, rotate about an axis extending in a substantially horizontal direction that is parallel to a direction in which the two container bodies are arranged, to thereby depress the two stems via the adjusting member, wherein the adjusting member includes a plurality of pressing portions against which the two stems are directly or indirectly pressed, and when the adjusting member is rotated about the axis extending in the substantially vertical direction, one of the plurality of pressing portions on a side of one of the two stems approaches the axis extending in the substantially horizontal direction in the plan view, whereby a depressing stroke of the one of the plurality of pressing portions on the side of the one of the two stems in response to a depressing operation of the pressing head becomes shorter, and another one of the plurality of pressing portions on a side of another one of the two stems moves away from the axis extending in the substantially horizontal direction, whereby a depressing stroke of the other one of the plurality of pressing portions on the side of the other one of the two stems in response to the depressing operation of the pressing head becomes longer.

In a preferred embodiment of the present dispensing container configured as above, the plurality of pressing portions of the adjusting member is configured to protrude downward from both end portions of an arm portion extending substantially in the horizontal direction, and the adjusting member is configured to be mounted to the pressing head so as to be rotatable about the axis extending in the substantially vertical direction.

In still another preferred embodiment of the present dispensing container configured as above, the adjusting member includes an operation lever that is orthogonal to a longitudinal direction of the arm portion and that protrudes to a side opposite to the axis extending in the substantially horizontal direction in the plan view, and the operation lever is configured to protrude in the substantially horizontal direction through a through hole provided in the pressing head.

In still another preferred embodiment of the present dispensing container configured as above, the adjusting member is configured to be coupled to a tab provided on an upper surface of the pressing head, so that rotation of the adjusting member is adjustable by rotating the tab.

In still another preferred embodiment of the present dispensing container configured as above, two nozzle portions are respectively mounted to the two stems, the two nozzle portions being configured to respectively guide the two kinds of contents pumped from the two pumps to two dispensing ports, and the adjusting member is configured to press the two stems via the nozzle portions.

In still another preferred embodiment of the present dispensing container configured as above, each of the two the nozzle portions is configured to be provided, in an upper end portion thereof on a side adjacent to the axis extending in the substantially horizontal direction in the plan view, with a recess that is recessed downward.

In still another preferred embodiment of the present dispensing container configured as above, each of the two nozzle portions is configured to be coupled to the corresponding dispensing port via a flexible tube.

Advantageous Effect

According to the present disclosure, a dispensing container that is capable of changing the ratio between the amounts of two kinds of contents to be dispensed can be provided.

DETAILED DESCRIPTION

Hereinafter, a first embodiment of the present disclosure will be described by illustration in more detail with reference to the drawings.

Figure 1:
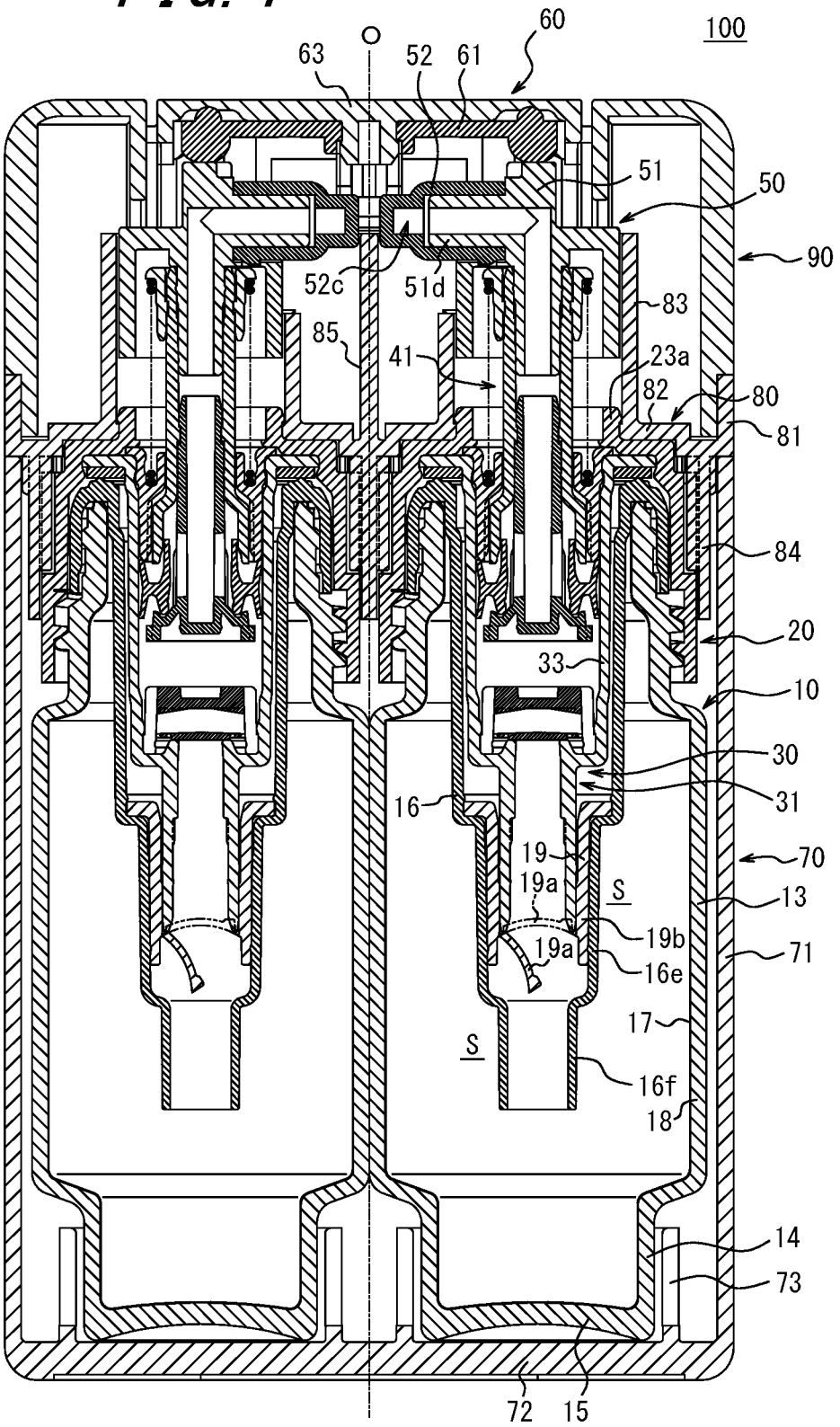
FIG. 1 is a front sectional view illustrating a dispensing container according to a first embodiment of the present disclosure.
Figure 2:
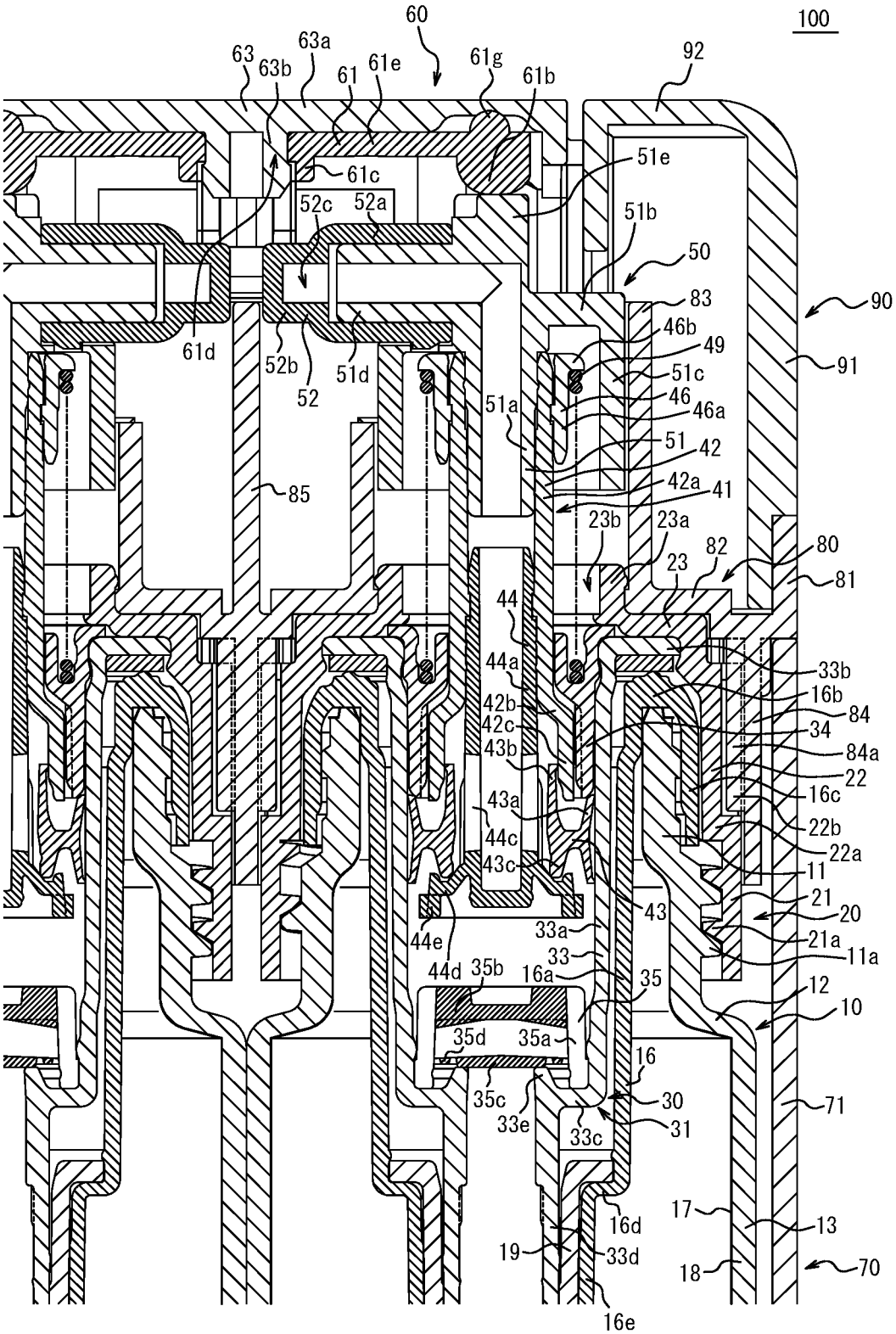
FIG. 2 is an enlarged sectional view illustrating a main part of the dispensing container of FIG. 1.

As illustrated in FIG. 1 and FIG. 2, a dispensing container 100 of the present embodiment is used to contain, for example, cosmetic lotions, hair dyes, or the like as contents (content liquids). The dispensing container 100 of the present embodiment includes container bodies 10 that can contain two kinds of contents individually, dispensing caps 20 that are mounted on mouths 11 of the container bodies 10, pumps 30 that pump the contents in the container bodies 10 to dispensing ports 52*c*, nozzle portions 50 that include the dispensing ports 52*c* through which the contents are dispensed, a head portion 60 that is configured to operate the pumps 30 in response to a pressing operation, an outer container 70 that covers the two container bodies 10 and the like from the outside, a coupling member 80 that couples the two container bodies 10 and the like, and a lid 90 that covers the nozzle portions 50 and the like.

In the present specification and in the claims, an up/down direction shall mean the up/down direction in a state in which the dispensing container 100 is in an upright position where a pressing head 63 is located on the upper side with respect to the container bodies 10 as illustrated in FIG. 1. Further, a radial direction shall mean the direction that passes through an axis O of the dispensing container 100 and that extends along a straight line perpendicular to the axis O. Moreover, the dispensing container 100 of the present embodiment includes two container bodies 10, two dispensing caps 20, two pumps 30, two nozzle portions 50, or the like, and the dispensing container 100 has a bilaterally symmetrical shape about the axis O in the example of FIG. 1.

The container bodies 10 are also referred to as laminated peelable containers (delamination containers) or double containers. Each container body 10 has a double structure including an outer layer body 18 and an inner layer body 17 accommodated on the inner side of the outer layer body 18, and in response to dispensing of the corresponding content (content liquid), the inner layer body 17 undergoes volume reduction and deformation independently from the outer layer body 18. Further, the container body 10 is provided, in the mouth 11 thereof, with a containing tubular portion 16 as a separate member. The containing tubular portion 16 covers the corresponding pump 30, which will be described later, from the outer side in the radial direction and includes an inner plug member 19.

The outer layer body 18 is a portion constituting an outer shell of the container body 10. As illustrated in FIG. 2, the outer layer body 18 includes the cylindrical-shaped mouth 11, a shoulder 12 that is integral and contiguous with a lower end of the mouth 11 and that has a diameter increasing downward so as to project to the outer side in the radial direction with respect to the mouth 11, a substantially cylindrical-shaped trunk 13 that is integral and contiguous with a lower end of the shoulder 12, a reduced-diameter portion 14 that is provided at a lower end portion of the trunk 13 and that has a diameter reduced toward the inner side in the radial direction than the trunk 13, and a bottom 15 that closes a lower end portion of the reduced-diameter portion 14.

As illustrated in FIG. 1, the inner layer body 17 defines a containing space S for the content.

In the present embodiment, the container body 10 has been formed into a laminated structure in which the inner layer body 17 is laminated in a peelable manner on an inner surface of the outer layer body 18, by co-extruding a synthetic resin material for the outer layer body 18 and a synthetic resin material for the inner layer body 17 that have low compatibility to thereby form a laminated parison and by blow molding the laminated parison with use of a mold. Additionally, the container body 10 may also be formed by biaxially stretch blow molding a preform having a laminated structure that has been formed in advance by injection molding or the like.

In the present embodiment, nylon is used as a material for the inner layer body 17 constituting the container body 10, and polypropylene (PP) is used as a material for the outer layer body 18. The present disclosure, however, is not limited to this embodiment, and an ethylene-vinyl alcohol copolymer resin (EVOH) may also be used as a material for the inner layer body 17, and high-density polyethylene resin (HDPE) or low-density polyethylene (LDPE) may be used as a material for the outer layer body 18. Further, in a case in which a laminated peelable container is formed by biaxial stretched blow molding, for example, polyethylene terephthalate (PET) may be used as a material for the outer layer body 18. It is to be noted that a material for the inner layer body 17 and a material for the outer layer body 18 are not limited to the above-described materials, and other resins having low compatibility with each other can be used as the materials. Further, the container body 10 does not necessarily need to be a laminated peelable container, and the outer layer body 18 and the inner layer body 17 may be formed separately and assembled together. Additionally, although not illustrated, one or more adhesive strips made of, for example, Admer® (Admer is a registered trademark in Japan, other countries, or both) may be disposed between the inner layer body 17 and the outer layer body 18 so that the adhesive strips extending in the up/down direction partially join the inner layer body 17 and the outer layer body 18.

In the present embodiment, the container body 10 is formed by blow molding and is configured so that air can be introduced into a space between the outer layer body 18 and the inner layer body 17 via a slit formed in a pinch-off portion at the bottom 15. When the content is dispensed from the dispensing port 52*c*, as much air as the amount of the dispensed content is taken into the space between the outer layer body 18 and the inner layer body 17 via the slit from the outside, and, while the inner layer body 17 undergoes volume reduction and deformation, the outer layer body 18 can maintain the original shape. That is, in a case in which the outer layer body 18 is made of a relatively more rigid material, such as polypropylene (PP), high-density polyethylene resin (HDPE), or polyethylene terephthalate (PET), the outer layer body 18 can continue to maintain the same shape regardless of the volume reduction and deformation undergone by the inner layer body 17. Further, in a case in which the outer layer body 18 is made of a relatively less rigid material, such as low-density polyethylene (LDPE), even when the outer layer body 18 temporarily undergoes volume reduction and deformation in conjunction with the volume reduction and deformation undergone by the inner layer body 17, air is subsequently taken into the space between the outer layer body 18 and the inner layer body 17 via the slit, whereby the outer layer body 18 can be restored to the original shape.

Because the above configuration prevents air from being taken into the inner layer body 17 from the outside, it is possible to prevent deterioration of the quality of the content due to oxidation or the like. Further, the content in the inner layer body 17 can be used up as much as possible so as to minimize the remaining amount, and moreover, even contents having high viscosities can be discharged. Besides, even in a case in which only a small amount of the content is discharged as described later, air corresponding to the dispensed amount can be taken into the space between the outer layer body 18 and the inner layer body 17 via the slit.

As illustrated in FIG. 2, the mouth 11 is integrally provided, on an outer circumferential surface thereof, with a male screw portion 11*a* to which the dispensing cap 20 can be screw-engaged. The male screw portion 11*a* protrudes to the outer side in the radial direction from the outer circumferential surface of the mouth 11.

Further, the containing tubular portion 16, which includes the inner plug member 19 (refer to FIG. 1) and which covers a lower assembly 31 of the pump 30 from the outer side in the radial direction, is fixed to the mouth 11.

As illustrated in FIG. 2, the containing tubular portion 16 has a tubular-shaped portion 16*a* that covers the cylinder 33 from the outer side in the radial direction, a flange portion 16*b* that is contiguous with an upper end portion of the tubular-shaped portion 16*a* and that protrudes to the outer side in the radial direction, an upper outer wall 16*c* that hangs down from an outer end of the flange portion 16*b*, a first reduced-diameter portion 16*e* that is contiguous with a lower end of the tubular-shaped portion 16*a* via a stepped portion 16*d* and that has a diameter smaller than that of the tubular-shaped portion 16*a*, and a second reduced-diameter portion 16*f* (refer to FIG. 1) that is contiguous with a lower end of the first reduced-diameter portion 16*e* and that has a diameter even smaller than that of the first reduced-diameter portion 16*e*.

The containing tubular portion 16 is positioned and fixed relative to the container body 10, with the upper end portion of the tubular-shaped portion 16*a* being fitted to an inner circumferential surface of the mouth 11 of the container body 10, thereby sandwiching the mouth 11 between the upper end portion of the tubular-shaped portion 16*a* and the upper outer wall 16*c*.

The inner plug member 19 is fitted and fixed to an inner surface of the first reduced-diameter portion 16*e*, and the inner plug member 19 includes an inner plug 19*a* for blocking communication between the containing space S of the container body 10 and the outside before assembly of the dispensing container 100 (refer to the inner plug 19*a* represented by a two-dot chain line in FIG. 1). Then, during assembly of the dispensing container 100, when the cylinder 33 is pushed into the containing tubular portion 16, a lower end portion of a fitting tube 33*d* presses the inner plug 19*a* to thereby break up a weakened portion coupling the inner plug 19*a* and a circumferential wall 19*b*, whereby the inner plug 19*a* is displaced to a position indicated by a solid line in FIG. 1, so that communication between the containing space S and the inside of the pump 30 is established. Accordingly, the content in the containing space S becomes ready to be pumped upward by the pump 30 and to be dispensed through the dispensing port 52*c* in response to the pressing head 63 being depressed.

Next, configurations of the dispensing caps 20 will be described with reference to FIG. 2.

Each dispensing cap 20 is made of polypropylene, and as illustrated in FIG. 2, the dispensing cap 20 is formed in a substantially topped cylindrical shape including an outer circumferential wall 21, an upper circumferential wall 22 that is contiguous with an upper end portion of the outer circumferential wall 21 via the stepped portion 22*a*, and a top wall 23 that closes an upper end portion of the upper circumferential wall 22. The dispensing cap 20 is mounted to the corresponding container body 10 so that the outer circumferential wall 21 and the upper circumferential wall 22 cover the mouth 11 from the outer side in the radial direction and so that the top wall 23 covers the mouth 11 from above. It is to be noted that the dispensing cap 20 may be formed from other resins, such as polyethylene.

The outer circumferential wall 21 is provided, on an inner circumferential surface thereof, with a female screw portion 21*a*. The female screw portion 21*a* protrudes to the inner side in the radial direction from the inner circumferential surface of the outer circumferential wall 21 and is configured to be screw-engaged with the male screw portion 11*a*.

The upper circumferential wall 22 is provided, on an outer circumferential surface thereof, with vertically extending outer circumferential ribs 22*b* that are disposed intermittently in the circumferential direction. Each outer circumferential rib 22*b* fits in between adjacent inner ribs 84*a* formed on an inner circumferential surface of a side wall portion 84 of the later-described coupling member 80, so as to be coupled with the coupling member 80 in a manner such that the coupling member 80 is prevented from rotating in the circumferential direction.

A fitting tube 23*a* is formed in a middle portion of the top wall 23 of the dispensing cap 20, and a communication hole 23*b*, which allows for vertical communication through the top wall 23, is provided on the inner side of the fitting tube 23*a*. As illustrated in FIG. 2, a stem 42 and a piston guide 44, which constitute an upper assembly 41 of the later-described pump 30, extend vertically through the communication hole 23*b*, so as to convey pressing force from the head portion 60 to the pump 30.

Next, configurations of the pumps 30 will be described with reference to FIG. 2. Each pump 30 of the present embodiment includes the lower assembly 31, which is fixed to the corresponding container body 10, and the upper assembly 41, which is configured to be movable in the up/down direction with respect to the lower assembly 31, so that the upper assembly 41 can be urged upward by an urging spring 49 and can be moved downward in response to pressing force from the head portion 60 to thereby pump the content in the cylinder 33.

As illustrated in FIG. 2, the lower assembly 31 of the pump 30 includes a cylinder 33 that stores the content from the corresponding containing space S, a second locking member 34 that fits to an inner circumferential surface of an upper end portion of the tubular-shaped portion 33*a* in the cylinder 33 so as to hold a lower end portion of the urging spring 49, and a draw valve member 35 that has a draw valve 35*c* and that is fitted in the inner circumferential surface of the cylinder 33.

The cylinder 33 includes a tubular-shaped portion 33*a* that stores therein the content in a state in which the upper assembly 41 is urged upward, a flange portion 33*b* that is provided at the upper end portion of the tubular-shaped portion 33*a* and that is sandwiched between the top wall 23 of the dispensing cap 20 and the mouth 11, a fitting tube 33*d* that is integrally formed at a lower end portion of the tubular-shaped portion 33*a* via a stepped portion 33*c* and that is fitted to an inner circumferential surface of a later-described blocking member 36, and a draw valve seat 33*e* that protrudes upward from an upper end portion of the fitting tube 33*d* and that allows the draw valve 35*c* to be seated thereon for closing the valve.

The draw valve member 35 includes a draw valve 35*c* that is elastically supported by a support member 35*d*, support frames 35*a* in which the draw valve 35*c* is supported, and an upper wall 35*b* that closes upper ends of the support frames 35*a*. The support frames 35*a* are intermittently formed in the circumferential direction, and when the draw valve 35*c* is displaced upward in response to a negative pressure in the cylinder 33 so that the valve is opened, the content in the containing space S passes through the inside of the fitting tube 33*d*, through a space between the draw valve 35*c* and the draw valve seat 33*e*, and through spaces between adjacent intermittently formed support frames 35*a*, thus flowing into the tubular-shaped portion 33*a* of the cylinder 33.

As illustrated in FIG. 2, the upper assembly 41 of the pump 30 includes a tubular-shaped stem 42 that conveys pressing force from the pressing head 63, a first locking member 46 that holds an upper end portion of the urging spring 49 by an outer circumferential surface of an upper end portion of the stem 42 being fitted thereto, a piston guide 44 that includes a guide body 44*a* fitted to an inner circumferential surface of the stem 42 and that also includes a discharge valve hole 44*c* and a discharge valve seat 44*d*, and an annular piston 43 that vertically moves by sliding on the inner circumferential surface of the tubular-shaped portion 33*a* of the cylinder 33.

The stem 42 includes a coupling tubular portion 42*a* that defines a moving space for the content and that has the upper end portion to which the corresponding nozzle portion 50 is fitted, and a large-diameter portion 42*c* that is contiguous with a lower end portion of the coupling tubular portion 42*a* via a stepped portion 42*b* and that has a diameter greater than that of the coupling tubular portion 42*a*. The piston guide 44 is fitted on the inner side of the coupling tubular portion 42*a*, and the upper end portion of the coupling tubular portion 42*a* is fitted to the first locking member 46 holding the upper end portion of the urging spring 49. Further, an inner wall upper end portion 43*b* of the annular piston 43 is configured to be slidable on an inner circumferential surface of the large-diameter portion 42*c*. The annular piston 43 has an inner wall lower end portion 43*c*, which, together with the discharge valve seat 44*d*, forms a discharge valve. That is, when the inner wall lower end portion 43*c* is seated on the discharge valve seat 44*d*, the discharge valve is closed, and when the inner wall lower end portion 43*c* is spaced from the discharge valve seat 44*d*, the discharge valve is opened so that the content can pass through the discharge valve hole 44*c*. Additionally, the annular piston 43 has an outer wall 43*a* that slides on the inner surface of the tubular-shaped portion 33*a* of the cylinder 33.

Next, the nozzle portions 50 will be described. Each nozzle portion 50 includes a mounting member 51 that is fitted to the upper end portion of the corresponding stem 42 and that guides the content pumped from the corresponding pump 30 to the dispensing port 52*c*, and a dispensing port member 52 that is mounted to a tip of the mounting member 51 and that has the dispensing port 52*c* for the content.

The mounting member 51 includes a perpendicular tubular portion 51*a* that defines a flow path through which the content is guided upward and that is fitted to the upper end portion of the stem 42, a horizontal tubular portion 51*d* that is perpendicular to the perpendicular tubular portion 51*a* and that guides the content to the dispensing port 52*c* in a horizontal direction, a ceiling wall 51*b* that is contiguous with an upper end portion of the perpendicular tubular portion 51*a*, and a circumferential wall 51*c* that hangs from an outer peripheral edge of the ceiling wall 51*b*, and a pressure-receiving portion 51*e* that is provided above the perpendicular tubular portion 51*a* and that abuts against a pressing portion 61*b* of a later-described adjusting member 61. In front views illustrated in FIG. 1 and FIG. 2, two horizontal tubular portions 51*d* are directed from both left and right sides toward the middle. Accordingly, the two kinds of contents pumped from the two container bodies 10 are guided to the middle and dispensed forward (in a direction from the back toward the front perpendicularly to the plane of paper in each of FIG. 1 and FIG. 2) through the two adjacent dispensing ports 52*c*.

Figure 3:
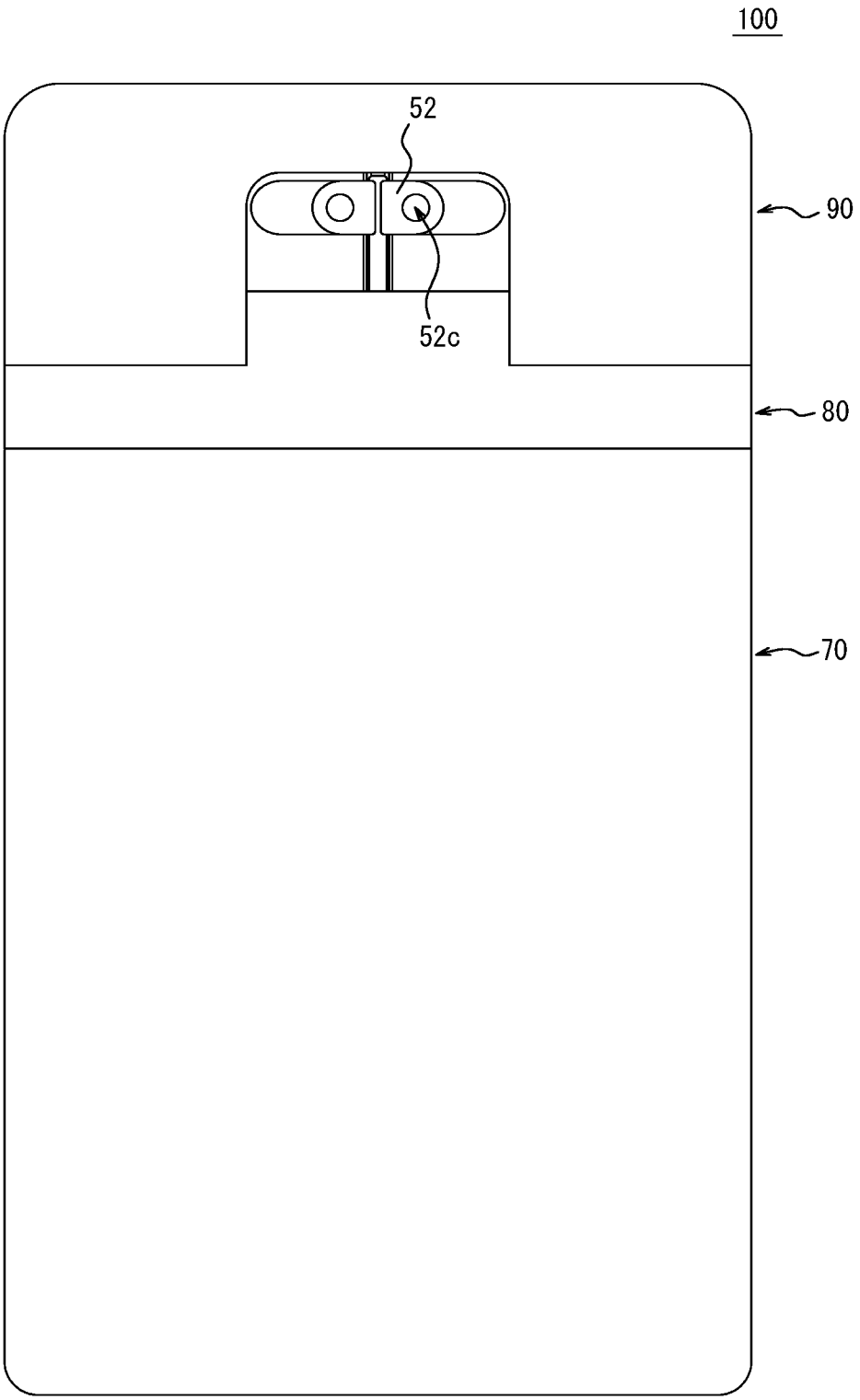
FIG. 3 is a front view illustrating the dispensing container of FIG. 1.
Figure 4:
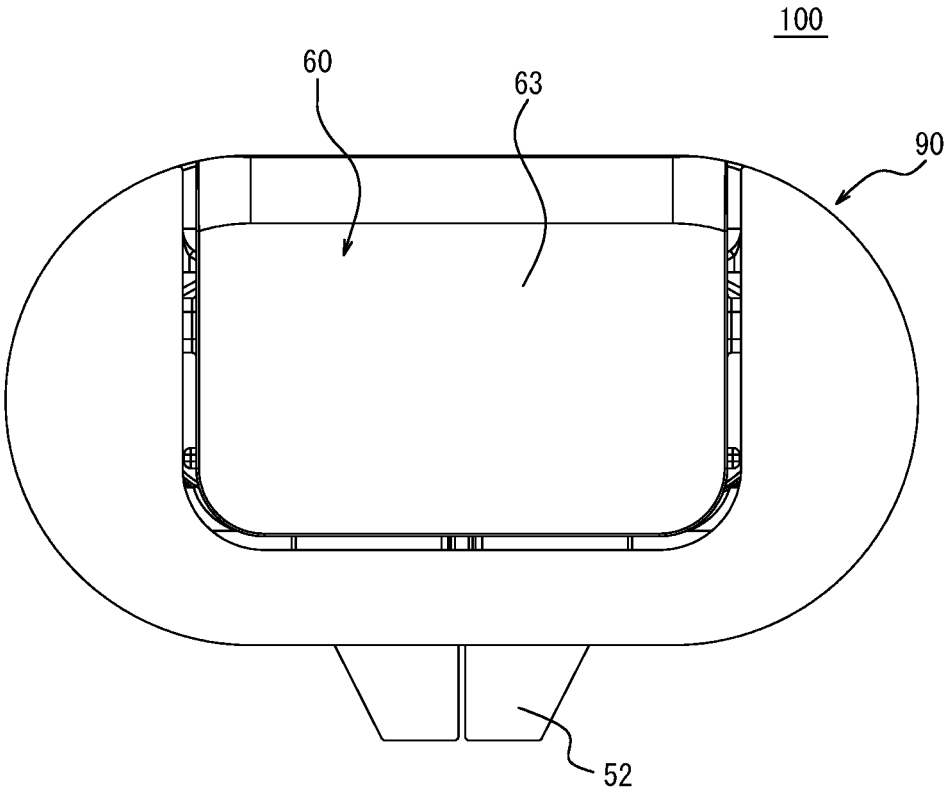
FIG. 4 is a plan view illustrating the dispensing container of FIG. 1.

The dispensing port member 52 includes a fitting tubular portion 52*a* to which an outer circumferential surface of the horizontal tubular portion 51*d* is fitted, and a dispensing port tubular portion 52*b* through which the content is guided forward after passing through the horizontal tubular portion 51*d*. Further, the dispensing port 52*c* is provided in the dispensing port tubular portion 52*b*. It is to be noted that a front view and a plan view for the dispensing container 100 including the dispensing port member 52 are respectively illustrated in FIG. 3 and FIG. 4.

Next, the head portion 60 will be described. The head portion 60 includes the adjusting member 61 that depresses the respective pressure-receiving portions 51*e* of the two mounting members 51 at a stroke ratio desired by the user, and the pressing head 63 through which pressing force is applied to the adjusting member 61.

Figure 5:
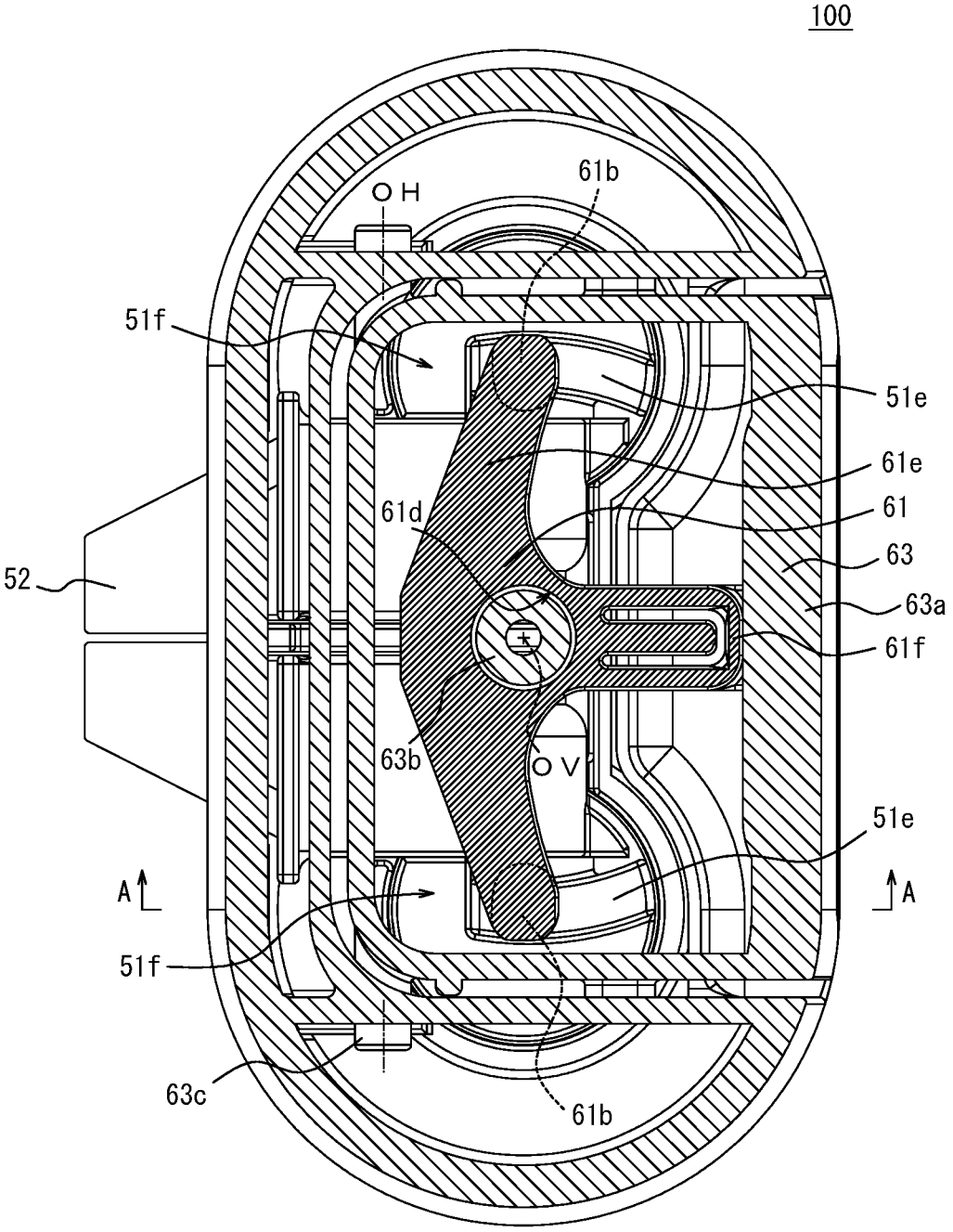
FIG. 5 is a plan sectional view illustrating the dispensing container of FIG. 1.
Figure 6A:
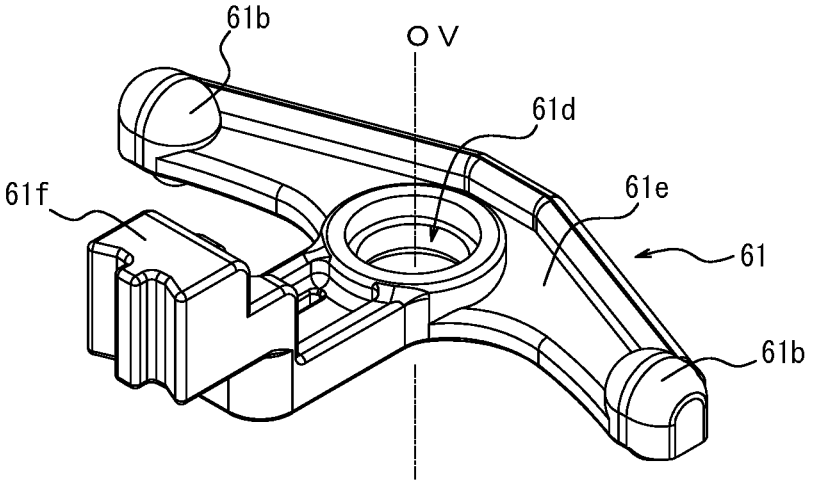
FIG. 6A is a perspective view illustrating an adjusting member constituting the dispensing container according to the first embodiment of the present disclosure as seen from a first direction.
Figure 6B:
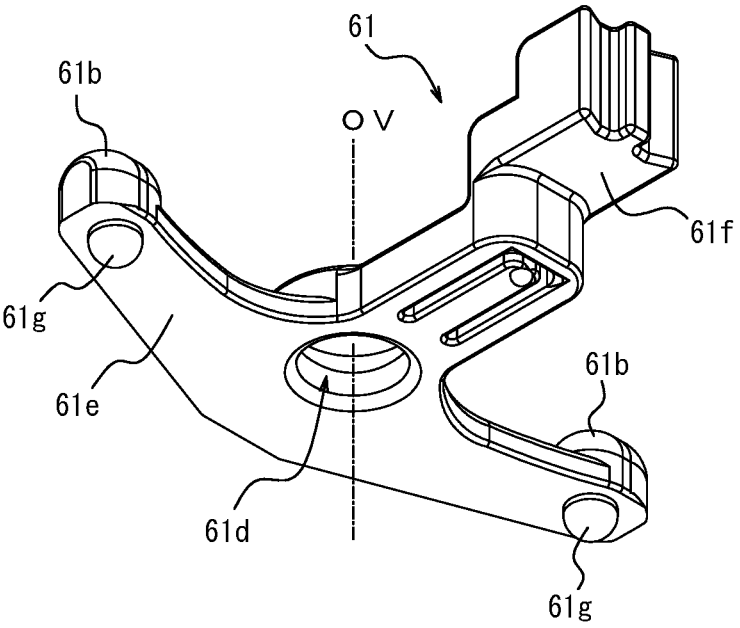
FIG. 6B is a perspective view illustrating the adjusting member constituting the dispensing container according to the first embodiment of the present disclosure as seen from a second direction.
Figure 7A:
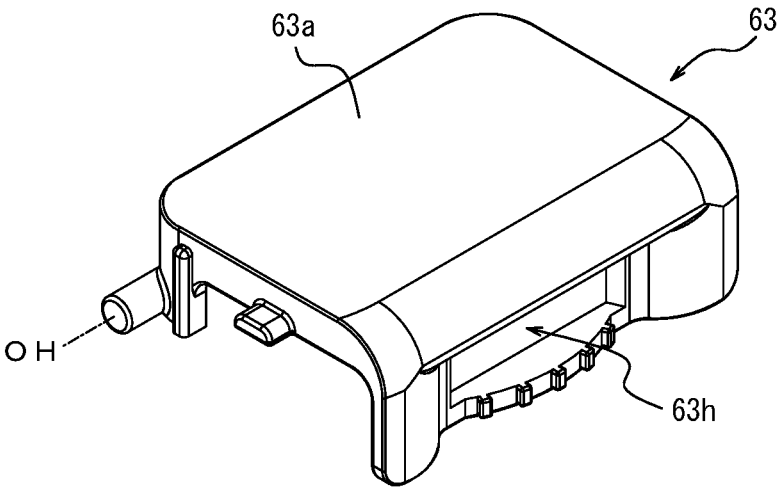
FIG. 7A is a perspective view illustrating a pressing head constituting the dispensing container according to the first embodiment of the present disclosure as seen from the first direction.
Figure 7B:
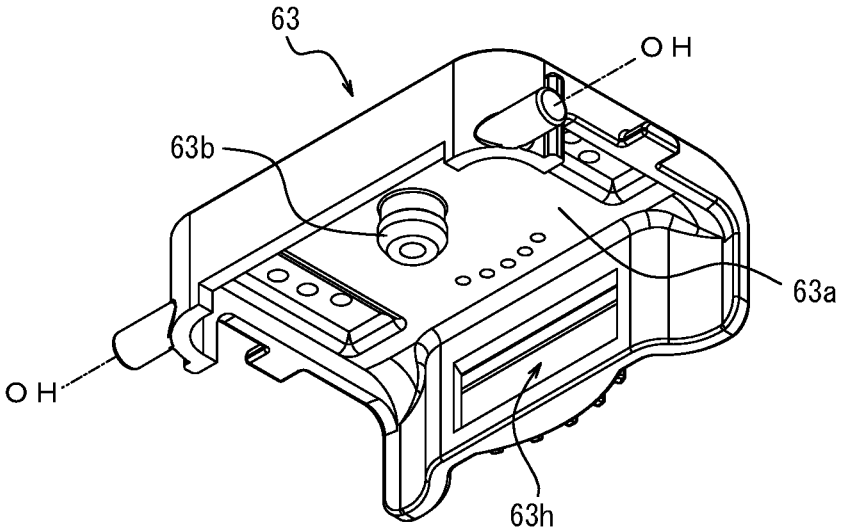
FIG. 7B is a perspective view illustrating the pressing head constituting the dispensing container according to the first embodiment of the present disclosure as seen from the second direction.

As illustrated in FIG. 5, FIG. 6A, and FIG. 6B, the adjusting member 61 includes an arm portion 61*e* that extends in a left/right direction (left/right direction in each of FIG. 1 and FIG. 2, which corresponds to the up/down direction of FIG. 5), the pressing portions 61*b* that are formed on lower surfaces of both end portions in the longitudinal direction of the arm portion 61*e*, and an operation lever 61*f* that is orthogonal to the longitudinal direction of the arm portion 61*e* and that protrudes to a side opposite to an axis OH extending in a substantially horizontal direction illustrated in FIG. 5. The adjusting member 61 is mounted to the pressing head 63 by fitting a rotation shaft 63*b* (refer to FIG. 5 and FIG. 7B), which is provided in the pressing head 63 to a rotation hole 61*d* provided in the adjusting member 61, and the adjusting member 61 is rotatable about the rotation shaft 63*b* (axis OV extending in a substantially vertical direction).

As illustrated in FIG. 5, the pressure-receiving portions 51*e* of the mounting members 51 are each provided in a shape along a trajectory of the corresponding pressing portion 61*b* when the adjusting member 61 is rotated about the axis OV extending in the substantially vertical direction. Further, as illustrated in FIG. 5, the pressure-receiving portions 51*e* are provided, in portions thereof on a side adjacent to an axis (axis OH extending in the substantially horizontal direction) serving as the rotation center of the pressing head 63 when the pressing head 63 is depressed downward, with recesses 51*f* that are recessed downward relative to the height of the pressure-receiving portions 51*e*. In the example of FIG. 5, the recesses 51*f* having a height equal to the height of an upper surface of the ceiling walls 51*b* are provided in the portions of the pressure-receiving portions 51*e* that are located on the side adjacent to the axis OH extending in the substantially horizontal direction.

Figure 8:
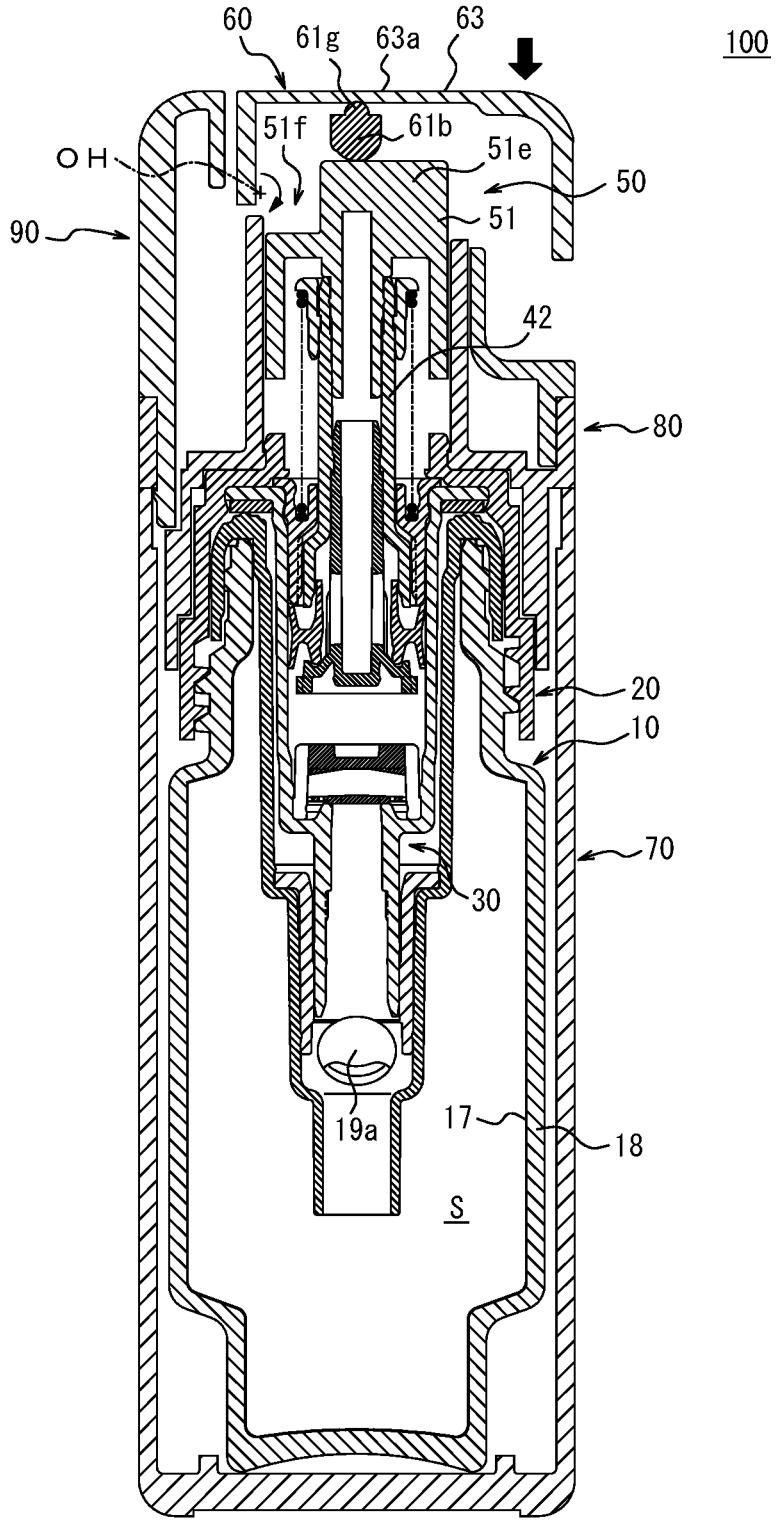
FIG. 8 is a right side sectional view illustrating the dispensing container of FIG. 1.

A rotation shaft 63*c* of the pressing head 63 is configured to be rotatable around a rotation groove (which is not illustrated) provided in the coupling member 80. Thus, when the pressing head 63 is depressed in the arrow direction illustrated in FIG. 8, the pressing head 63 rotates about the rotation shaft 63*c* (axis OH extending in the substantially horizontal direction). Accordingly, the greater a distance (distance in the left/right direction in FIG. 5 and FIG. 8) between the rotation shaft 63*c* (axis OH extending in the substantially horizontal direction) and the pressing portion 61*b* in the plan view, the greater a stroke of the pressing portion 61*b* depressed by a pressing plate 63*a* via an abutment portion 61*g* becomes, provided that the pressing head 63 is rotated through the same angle (refer to FIG. 5 and FIG. 8). A stroke of the corresponding stem 42 depressed by the pressing portion 61*b* becomes greater accordingly. It is therefore possible to relatively increase the amount of the content to be dispensed by the stem 42 (pump 30) depressed by one of the pressing portions 61*b* that is at a greater distance from the axis OH extending in the substantially horizontal direction, by rotating the adjusting member 61 about the axis OV extending in the substantially vertical direction to thereby make respective distances (distances in the left/right direction in FIG. 5 and FIG. 8) from the axis OH extending in the substantially horizontal direction to the two pressing portions 61*b* different from each other in FIG. 5. Thus, the ratio between the two kinds of contents to be dispensed can be changed.

Figure 9:
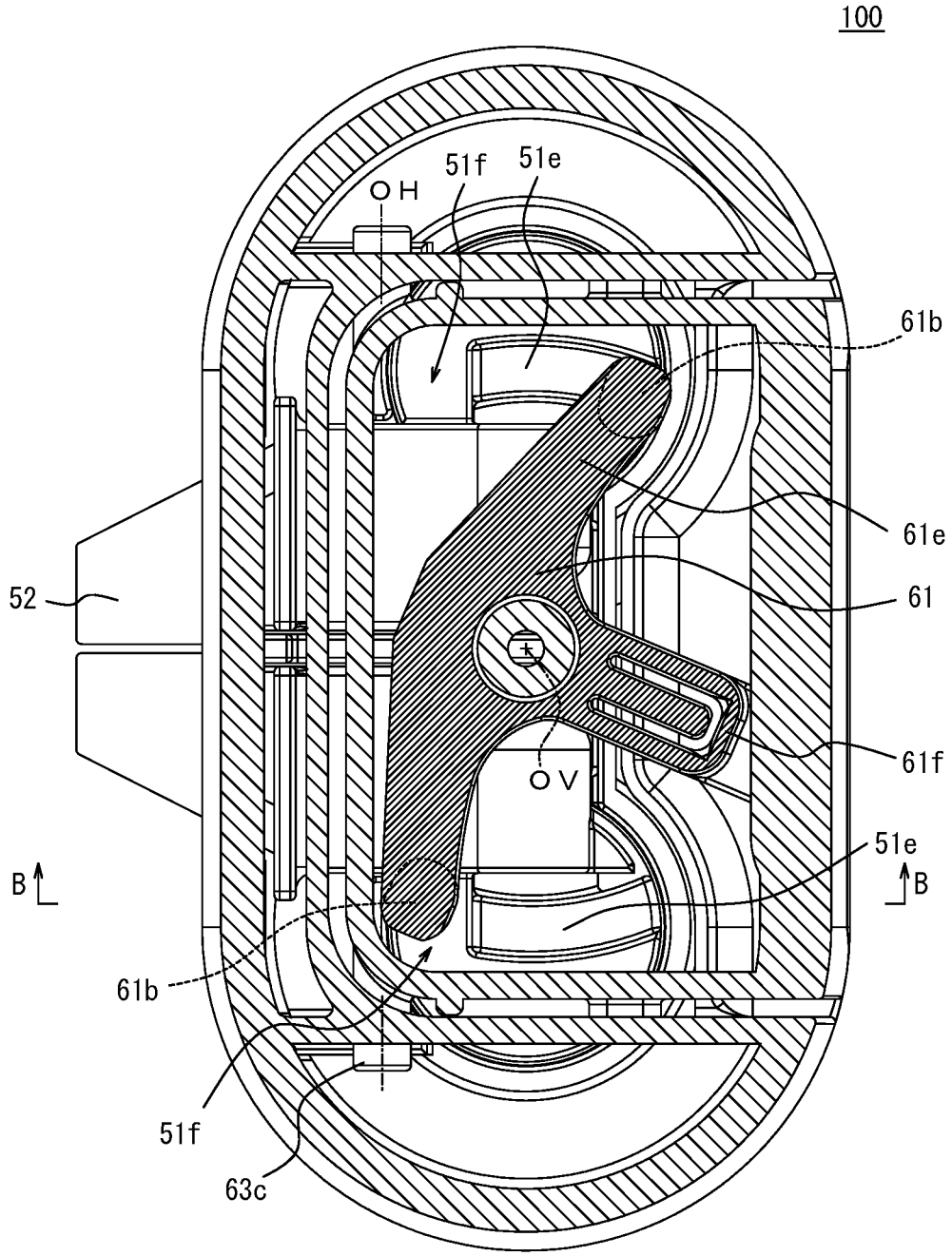
FIG. 9 is a plan sectional view illustrating a state in which only one of content liquids can be dispensed as a result of rotation of the adjusting member in FIG. 5.
Figure 10:
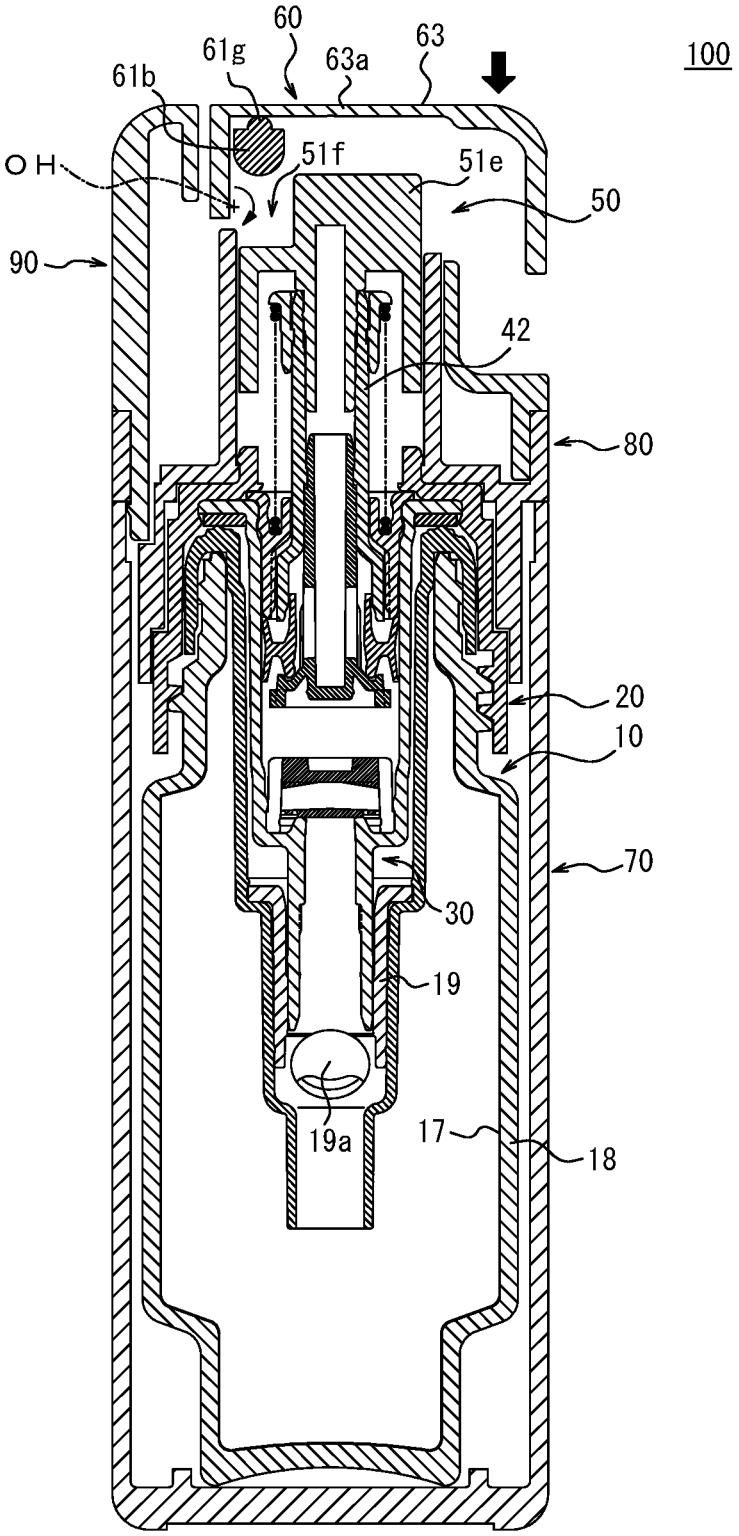
FIG. 10 is a right side sectional view illustrating a state in which only one of the content liquids can be dispensed as a result of rotation of the adjusting member in FIG. 8.

In particular, when one of the pressing portions 61*b* is above the recess 51*f* as illustrated in FIG. 9 and FIG. 10, even when the pressing head 63 is depressed, the pressing portion 61*b* above the recess 51*f* is not able to press the corresponding mounting member 51, and therefore, one of the pumps 30 whose corresponding pressing portion 61*b* is above the recess 51*f* does not operate. This means that only the other pump 30 can operate, and so only one of the two kinds of contents can be dispensed in a selectable manner.

Figure 11:
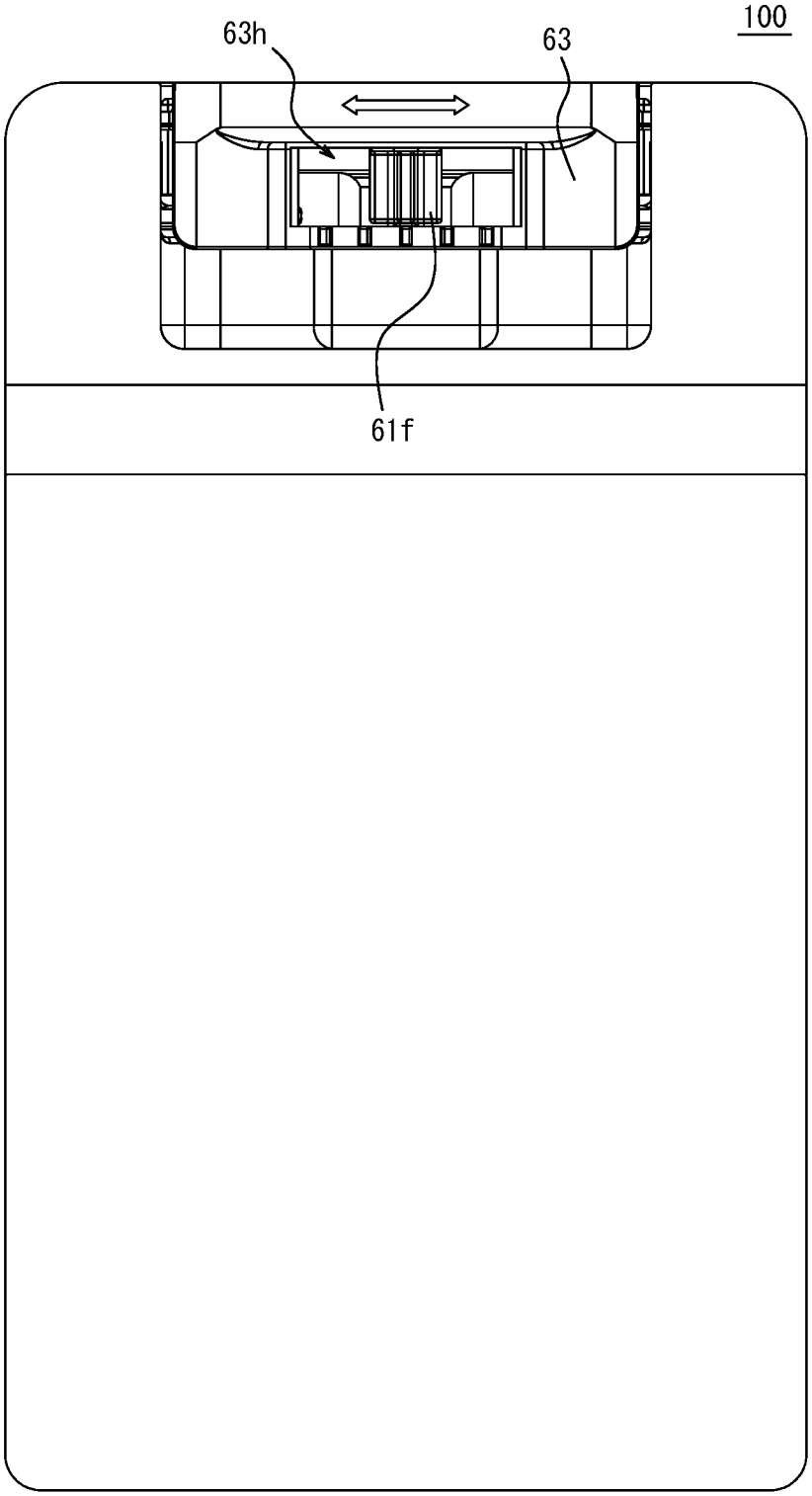
FIG. 11 is a rear view illustrating the dispensing container of FIG. 1.

As illustrated in FIG. 11, rotation of the adjusting member 61 can be adjusted by rotating the adjusting member 61 about the axis OV extending in the substantially vertical direction by pinching the operation lever 61*f* provided in the adjusting member 61 and moving the operation lever 61*f* in the left/right direction indicated by the arrow. In the illustrated example, because the operation lever 61*f* protrudes in the horizontal direction by passing through a through hole 63*h* (refer to FIG. 7A and FIG. 7B) provided in the pressing head 63, the operation lever 61*f* can be pinched easily, and operation of the adjusting member 61 is simplified.

The outer container 70 has an enough size to accommodate the two container bodies 10, and the outer container 70 includes a side wall portion 71 and a bottom portion 72 closing a lower end of the side wall portion 71. The bottom portion 72 is provided with two positioning walls 73 for accommodating and positioning the reduced-diameter portions 14 of the container bodies 10.

The coupling member 80 for coupling and positioning the two dispensing caps 20 is fitted to an inner circumferential surface of an upper end portion of the outer container 70. The coupling member 80 includes the side wall portion 84 that surrounds the outer circumferential walls 21 of the dispensing caps 20, an upper wall 82 that is contiguous with an upper end portion of the side wall portion 84 and that couples the two dispensing caps 20, a circumferential wall 81 that extends upward from an outer peripheral edge of the upper wall 82, two upper tubular walls 83 that each extend upward from an upper surface of the upper wall 82 and that each surround the corresponding nozzle portion 50 from the outer side in the radial direction, a partition wall 85 that divides the dispensing caps 20, the pumps 30 and the nozzle portions 50 in the middle in the left/right direction. As illustrated in FIG. 1, the dispensing caps 20 are fixed to the coupling member 80 in a manner such that the dispensing caps 20 are prevented from slipping off in the up/down direction, by the fitting cylinders 23*a* of the dispensing caps 20 being fitted to inner circumferential surfaces of the upper tubular walls 83. Further, the dispensing caps 20 are fixed to the coupling member 80 in a manner such that the dispensing caps 20 are prevented from rotating, by the outer circumferential ribs 22*b* of the dispensing caps 20 each being fitted in between adjacent inner ribs 84*a* formed on the inner circumferential surface of the side wall portion 84 of the coupling member 80.

The lid 90 includes an outer circumferential wall 91 that covers the nozzle portions 50 and the head portion 60 from the outer side in the radial direction, and an upper wall 92 that is contiguous with an upper end portion of the outer circumferential wall 91. Further, the lid 90 is fixed to the coupling member 80, by a lower end portion of the outer circumferential wall 91 being fitted to an inner circumferential surface of the circumferential wall 81. The lid 90 covers an area above the coupling member 80 except for an upper surface of the pressing head 63 from the outer side in the radial direction and from above. In the plan view, the outer circumferential wall 91 of the lid 90 is configured to be substantially aligned with the circumferential wall 81 of the coupling member 80 and with the side wall portion 71 of the outer container 70.

To dispense the contents from the dispensing container 100 with the above configuration, the user first depresses the pressing head 63 in an upright state of the dispensing container 100 illustrated in FIG. 1. At this time, the pressing head 63 is rotated about the axis OH extending in the substantially horizontal direction illustrated in FIG. 5 and FIG. 8, thereby depressing each pressing portion 61*b* with a stroke substantially proportional to a distance in the horizontal direction between the axis OH extending in the substantially horizontal direction and the pressing portion 61*b*. The user, therefore, can change the stroke of each pressing portion 61*b* depressing the corresponding stem 42, by rotating the adjusting member 61 about the axis OV extending in the substantially vertical direction in the state illustrated in FIG. 5 and FIG. 8 so as to change the distance in the horizontal direction between the axis OH extending in the substantially horizontal direction and the pressing portion 61*b*. This allows for dispensing of the two kinds of contents in the respective container bodies 10 corresponding to the stems 42 while changing the ratio between their amounts to be dispensed.

When the stem 42 constituting the upper assembly 41 of each pump 30 is depressed in response to the pressing head 63 being depressed, the piston guide 44, which is fitted and fixed to the inner circumferential surface of the stem 42, also moves downward at the same time. At this time, the inner wall upper end portion 43*b* of the annular piston 43 is only slightly displaced because the inner wall upper end portion 43*b* slides against the inner circumferential surface of the large-diameter portion 42*c*. Accordingly, the discharge valve seat 44*d* of the piston guide 44 is separated from the inner wall lower end portion 43*c* of the annular piston 43, whereby the discharge valve is temporarily brought into an open state.

As a result of downward displacement of the lower end portion 44*e* of the piston guide 44, the content stored in the cylinder 33 is compressed, passes through the opened discharge valve, and flows into the piston guide 44 through the discharge valve hole 44*c* so as to be pumped upward. Although the stem 42 moves downward by a distance corresponding to a pressing stroke of the pressing portion 61*b*, the stem 42 stops, at farthest, at a position where the lower end portion 44*e* of the piston guide 44 comes into abutment against the upper wall 35*b* of the draw valve member 35. As is apparent from FIG. 2 and the like, the greater the stroke of the stem 42 and the greater the downward displacement of the piston guide 44, the greater the volume of the content to be pumped upward through the discharge valve and the greater the amount of the content that can be dispensed through the dispensing port 52*c*.

When the user stops depressing the pressing head 63, the first locking member 46 is pushed back upward by restoring force of the urging spring 49. Accordingly, the stem 42, which is fitted to the inner circumferential surface of the first locking member 46, is also pulled upward together with the piston guide 44, thereby causing a negative pressure inside the cylinder 33. Further, because the inner wall lower end portion 43*c* of the annular piston 43 is not seated on the discharge valve seat 44*d* immediately after the stem 42 and the piston guide 44 start to be displaced upward, some of the content within a passage leading from an inner space of the piston guide 44 to the dispensing port 52*c* that corresponds to a change in volume inside the cylinder 33 is drawn downward by the negative pressure. This effect, which is also referred to as a suck back effect, causes the content remaining in the passage to be drawn into the cylinder 33, to thereby prevent liquid-dripping from the dispensing port 52*c*. As upward displacement of the piston guide 44 further continues, the discharge valve seat 44*d* abuts against the inner wall lower end portion 43*c* to be sealed, so that the discharge valve is closed. In conjunction with the closing of the discharge valve, the draw valve 35*c* of the draw valve member 35 is in turn lifted upward by the aforementioned negative pressure against its own weight and against elastic force of the support member 35*d*, so that the draw valve 35*c* is opened. The content in the containing space S is drawn up by the negative pressure inside the cylinder 33, passes through the draw valve 35*c*, and passes through spaces between adjacent support frames 35*a* so as to be stored in the cylinder 33.

When the stem 42 reaches the uppermost point in its movable range, the content stops from being drawn from the containing space S into the cylinder 33, and the draw valve 35*c* is seated on the draw valve seat 33*e* again. At this time, although the inner layer body 17 undergoes volume reduction and deformation in conjunction with a decrease in the content in the containing space S, since the draw valve 35*c* is closed, air cannot be taken into the inner layer body 17 from the outside. This prevents deterioration of the quality of the content due to oxidation or the like. Further, since air is introduced into the space between the outer layer body 18 and the inner layer body 17 via the slit formed at the bottom 15 of the container body 10, the outer layer body 18 can maintain the original shape even when the inner layer body 17 undergoes volume reduction and deformation. In particular, by changing the ratio between the amounts of the two kinds of contents to be dispensed, even in a case in which the amount of one of the contents to be dispensed is small, an amount of air corresponding to the small amount dispensed is introduced into the space between the outer layer body 18 and the inner layer body 17 via the slit at the bottom 15. Thus, the outer layer body 18 can easily maintain the original shape.

As described above, a dispensing container of the present embodiment includes: two container bodies 10 configured to respectively contain two kinds of contents; two pumps 30 respectively including two protruding stems 42 configured to be depressed in an upwardly urged state, the two pumps 30 being configured to respectively pump the two kinds of contents in the two container bodies 10 upward in response to the two stems 42 being depressed; an adjusting member 61 configured to directly or indirectly press the two stems 42 and configured to be rotatable about an axis OV extending in a substantially vertical direction that is located between the two container bodies 10 in a plan view; and a pressing head 63 configured to, in response to a depressing operation, rotate about an axis OH extending in a substantially horizontal direction that is parallel to a direction in which the two container bodies 10 are arranged, to thereby depress the two stems 42 via the adjusting member 61, wherein the adjusting member 61 includes a plurality of pressing portions 61*b* against which the two stems 42 are directly or indirectly pressed, and when the adjusting member 61 is rotated about the axis OV extending in the substantially vertical direction, one of the plurality of pressing portions 61*b* on a side of one of the two stems approaches the axis OH extending in the substantially horizontal direction in the plan view, whereby a depressing stroke of the one of the plurality of pressing portions 61*b* on the side of the one of the two stems in response to a depressing operation of the pressing head 63 becomes shorter, and another one of the plurality of pressing portions 61*b* on a side of another one of the two stems moves away from the axis OH extending in the substantially horizontal direction, whereby a depressing stroke of the other one of the plurality of pressing portions 61*b* on the side of the other one of the two stems in response to the depressing operation of the pressing head 63 becomes longer. Adopting such a configuration allows for dispensing in which the ratio between the amounts of the two kinds of contents to be dispensed can be changed by adjusting rotation of the adjusting member 61 before depressing the pressing head 63 and dispensing the contents. In particular, because in the present embodiment the ratio between the amounts to be dispensed can be adjusted by adjusting rotation of the adjusting member 61, the two kinds of contents can be dispensed while changing the ratio between the amounts of the two kinds of contents to be dispensed, without having to change relative positions of the container bodies 10 and the dispensing ports 52*c*.

Further, in the present embodiment, the plurality of pressing portions 61*b* of the adjusting member 61 is configured to protrude downward from both end portions of an arm portion 61*e* extending substantially in the horizontal direction, and the adjusting member 61 is configured to be mounted to the pressing head 63 so as to be rotatable about the axis OV extending in the substantially vertical direction. By adopting such a configuration, the adjusting member 61 can be configured to be compact, and moreover, the stems 42 can be reliably depressed by the pressing portions 61*b* protruding downward to thereby operate the pumps 30.

Further, in the present embodiment, the adjusting member 61 includes an operation lever 61*f* that is orthogonal to a longitudinal direction of the arm portion 61*e* and that protrudes to a side opposite to the axis OH extending in the substantially horizontal direction in the plan view, and the operation lever 61*f* is configured to protrude in the substantially horizontal direction through a through hole 63*h* provided in the pressing head 63. By adopting such a configuration, rotation of the adjusting member 61, which is disposed between the pressing head 63 and the stems 42, can be easily adjusted by using the operation lever 61*f*.

Further, in the present embodiment, two nozzle portions 50 are respectively mounted to the two stems 42, and the adjusting member 61 is configured to press the two stems 42 via the nozzle portions 50. The two nozzle portions 50 are configured to respectively guide the two kinds of contents pumped from the two pumps 30 to two dispensing ports 52*c*. By adopting such a configuration, the stems 42 can be pressed more easily compared with a case in which the adjusting member 61 directly presses the stems 42, and moreover, the contents can be easily guided to the dispensing ports 52*c* by changing directions of the contents at the nozzle portions 50.

Further, in the present embodiment, each of the two the nozzle portions 50 is configured to be provided, in an upper end portion thereof on the side adjacent to the axis OH extending in the substantially horizontal direction in the plan view, with a recess 51*f* that is recessed downward. By adopting such a configuration, a state in which one of the two kinds of contents cannot be dispensed may be created without difficulty.

In the following, a dispensing container 200 according to a second embodiment of the present disclosure will be described by illustration in detail with reference to the drawings.

It is to be noted that, compared with the first embodiment, the dispensing container 200 according to the second embodiment is similar to the first embodiment, except for the following points: the functions of the dispensing caps 20 and the coupling member 80 are realized by a dispensing cap 120 alone; the functions of the mounting members 51 and the dispensing port members 52 in the nozzle portions 50 are realized by mounting members 151, dispensing port members 152, and flexible tubes 153 of nozzle portions 150; the functions of the adjusting member 61 and the operation lever 61*f* of the head portion 60 are realized by an adjusting member 161 and a tab 165 of a head portion 160; and pipes P are fitted inside the second reduced-diameter portions 16*f* of the containing tubular portions 16. The description herein will therefore focus on the points different from the first embodiment.

Figure 12:
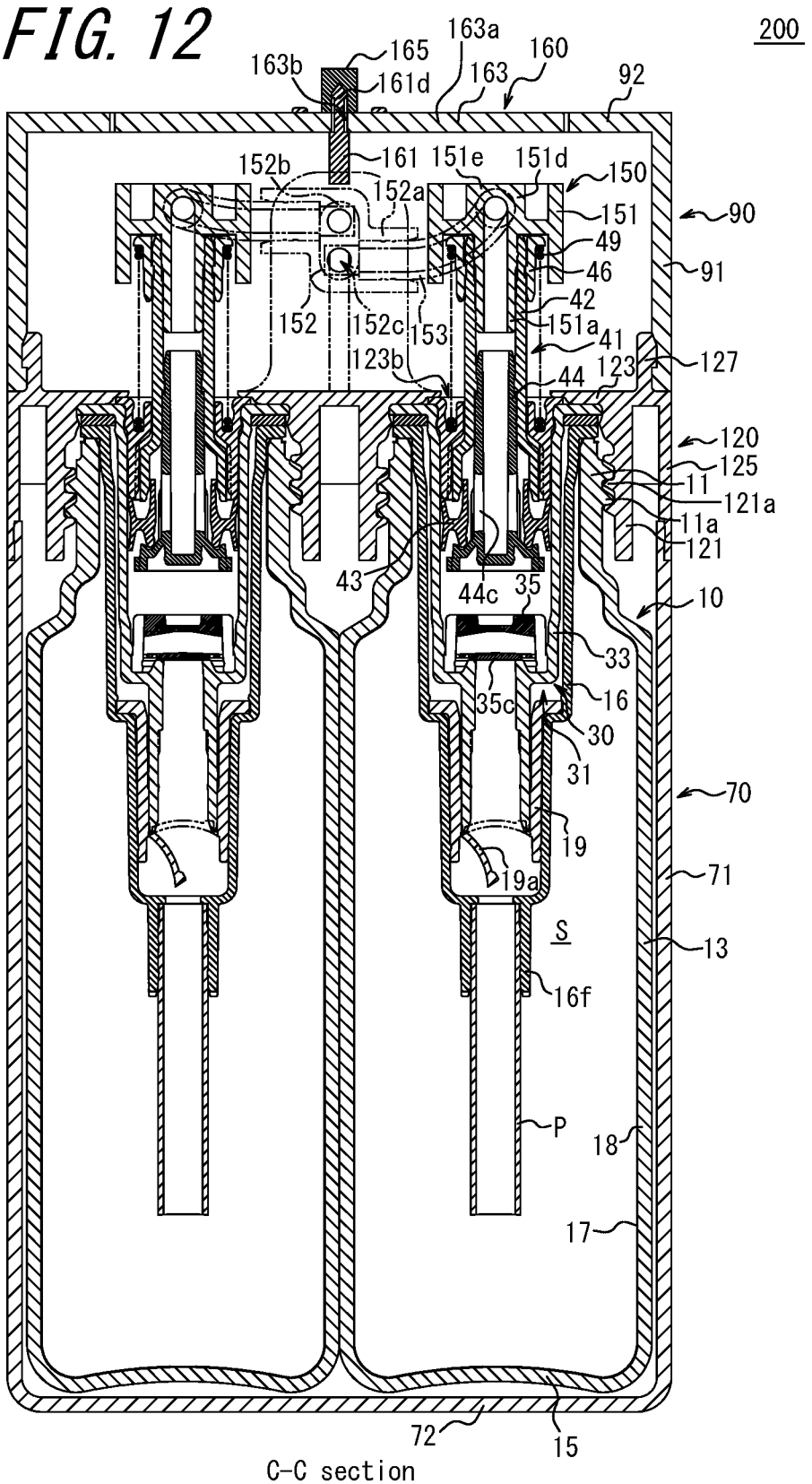
FIG. 12 is a front sectional view illustrating a dispensing container according to a second embodiment of the present disclosure.

The dispensing cap 120 of the present embodiment is made of polypropylene, and as illustrated in FIG. 12, dispensing cap 120 includes two inner circumferential walls 121 that are respectively mounted to the mouths 11 of the two container bodies 10, an outer circumferential wall 125 that has a rectangular shape with rounded corners in the plan view and that surrounds the two inner circumferential walls 121 from the outer side, a top wall 123 that is contiguous with respective upper end portions of the inner circumferential walls 121 and the outer circumferential wall 125, and an upper circumferential wall 127 that extends further upward from an upper surface of the top wall 123 and that is used to mount the lid 90 thereon by fitting to an inner circumferential surface of a lower end portion of the outer circumferential wall 91 in the lid 90. The dispensing cap 120 is mounted to the container bodies 10 so that the inner circumferential walls 121 cover the mouths 11 from the outer side in the radial direction and that the top wall 123 covers the mouths 11 from above. Additionally, the dispensing cap 120 may be formed from other resins, such as polyethylene.

Each inner circumferential wall 121 is provided, on an inner circumferential surface thereof, with a female screw portion 121*a*. The female screw portion 121*a* protrudes to the inner side in the radial direction from the inner circumferential surface of the inner circumferential wall 121, and the female screw portion 121*a* is configured to be screw-engaged with the male screw portion 11*a*.

An upper end portion of the side wall portion 71 of the outer container 70 is fitted to an inner circumferential surface of a lower end portion of the outer circumferential wall 125. The outer circumferential wall 125 has a substantially rectangular shape that is substantially aligned with the outer circumferential wall 91 of the lid 90 and the side wall portion 71 of the outer container 70 in the plan view. Thus, the dispensing container 200 has a prismatic outer shape having substantially the same sectional shape in the plan view from the lid 90 to the outer container 70.

The top wall 123 of the dispensing cap 120 is provided with two communication holes 123*b*. As illustrated in FIG. 12, the stems 42 and the piston guides 44 constituting the upper assemblies 41 of the pumps 30 extend vertically through the communication holes 123*b*, so as to convey pressing force from the head portion 160 to the pumps 30.

Next, the nozzle portions 150 will be explained. Each nozzle portion 150 includes a mounting member 151 that is fitted to an upper end portion of the corresponding stem 42 and that guides the content pumped from the corresponding pump 30 to a dispensing port 152*c*, a flexible tube 153 that is mounted to a horizontal tubular portion 151*d* of the mounting member 151 so as to flexibly couple the mounting member 151 and the dispensing port member 152, and the dispensing port member 152 that is provided with the dispensing port 152*c* for the content.

The mounting member 151 has a vertical tubular portion 151*a* that defines a flow path for guiding the content upward and that is fitted to the upper end portion of the stem 42, a horizontal tubular portion 151*d* that is orthogonal to the vertical tubular portion 151*a* and that guides the content in the horizontal direction, and a pressure-receiving portion 151*e* that is provided above the vertical tubular portion 151*a* so that a pressing portion 161*b* of a later-described adjusting member 161 abuts against the pressure-receiving portion 151*e*. The horizontal tubular portion 151*d* is directed in a direction perpendicular to the plane of the paper in the front view illustrated in FIG. 12.

Figure 13A:
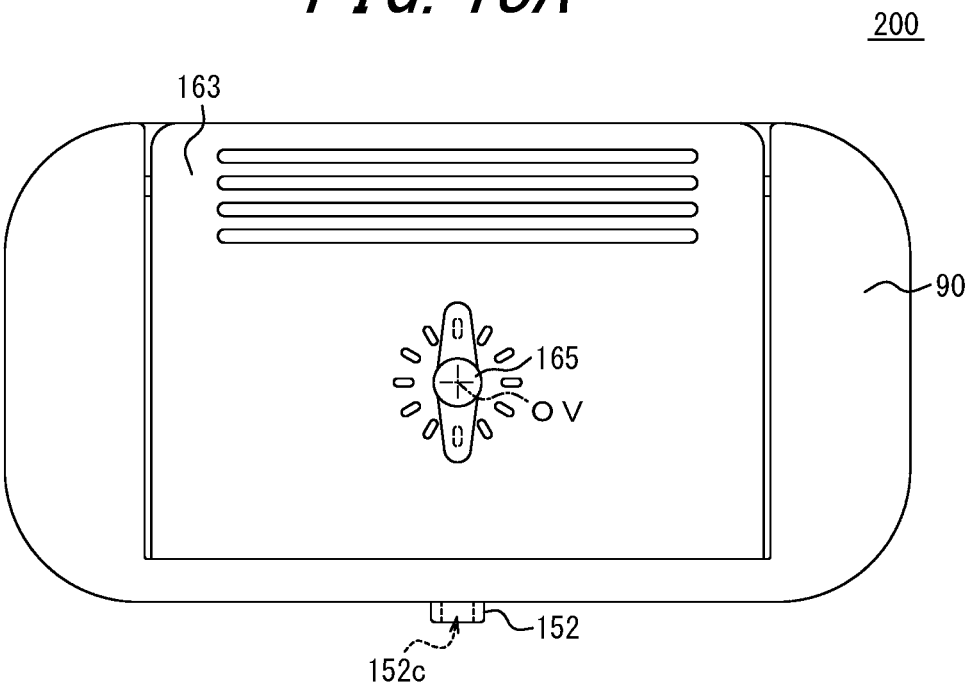
FIG. 13A is a plan view illustrating the dispensing container of FIG. 12.
Figure 13B:
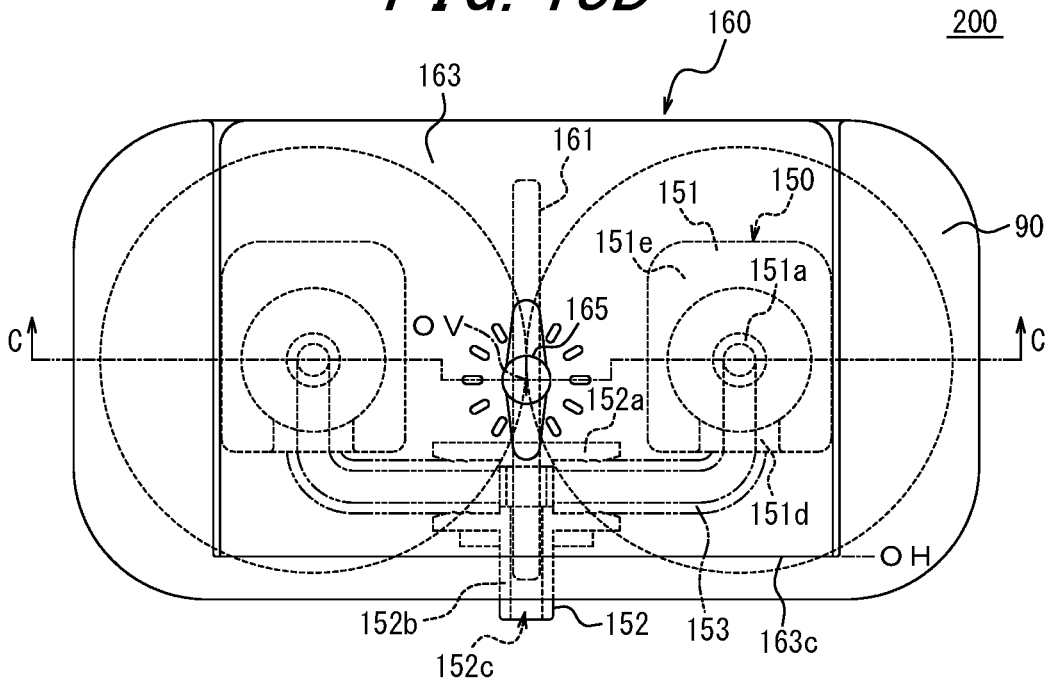
FIG. 13B is a plan view illustrating the dispensing container of FIG. 12.

As illustrated in FIG. 12 and FIG. 13B, the horizontal tubular portion 151*d* is coupled to a fitting tubular portion 152*a* of the dispensing port member 152 by the flexible tube 153. As illustrated in FIG. 13B, the flexible tube 153 is bent at substantially 90 degrees, to thereby guide the content to flow in from either side in the left/right direction of the dispensing port member 152 after being discharged forward from the horizontal tubular portion 151*d*.

Figure 15:
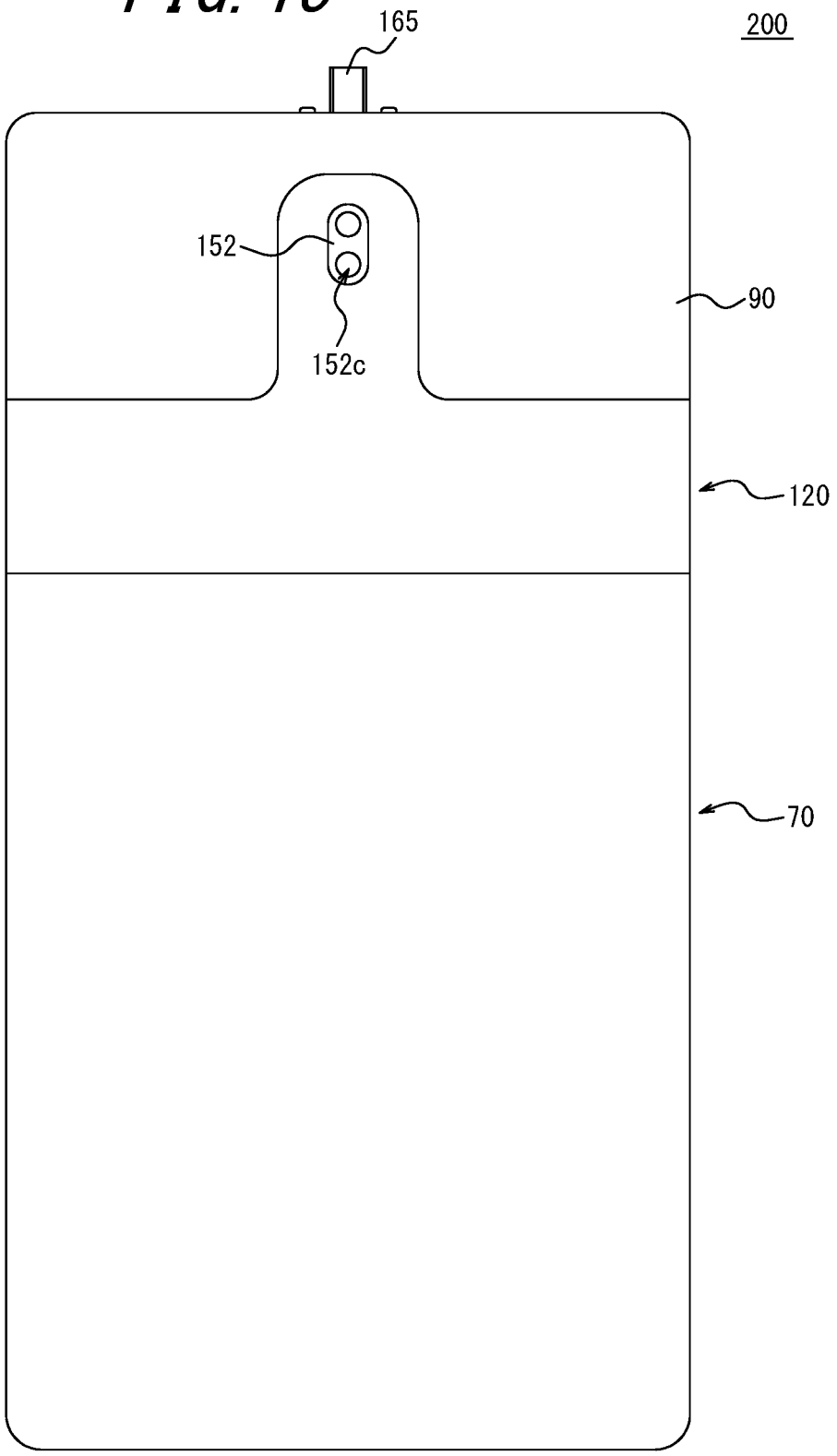
FIG. 15 is a front view illustrating the dispensing container of FIG. 12.

The dispensing port member 152 includes the fitting tubular portion 152*a* to which an outer circumferential surface of the flexible tube 153 is fitted, and a dispensing port tubular portion 152*b* through which the content is guided forward. Further, the dispensing port tubular portion 152*b* is provided, inside thereof, with a dispensing port 152*c*. It is to be noted that a plan view and a front view of the dispensing container 200 including the dispensing port member 152 are illustrated in FIG. 13A and FIG. 15.

Figure 17A:
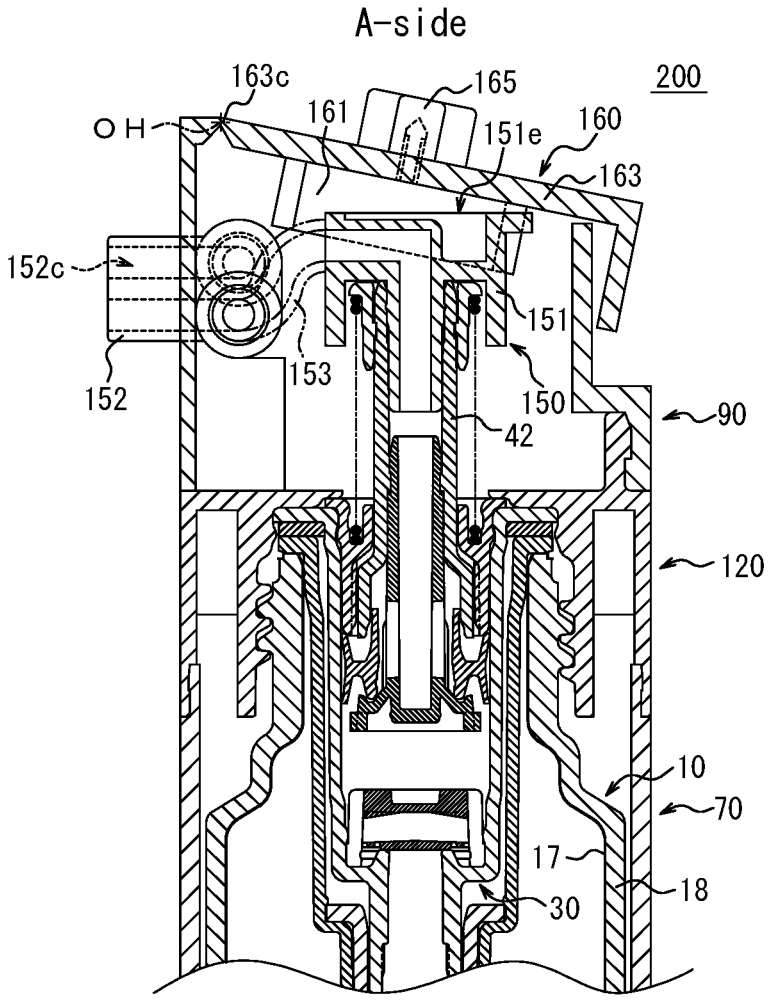
FIG. 17A is a right side sectional view illustrating the dispensing container in the state of FIG. 16 (from the side of container A)
Figure 17B:
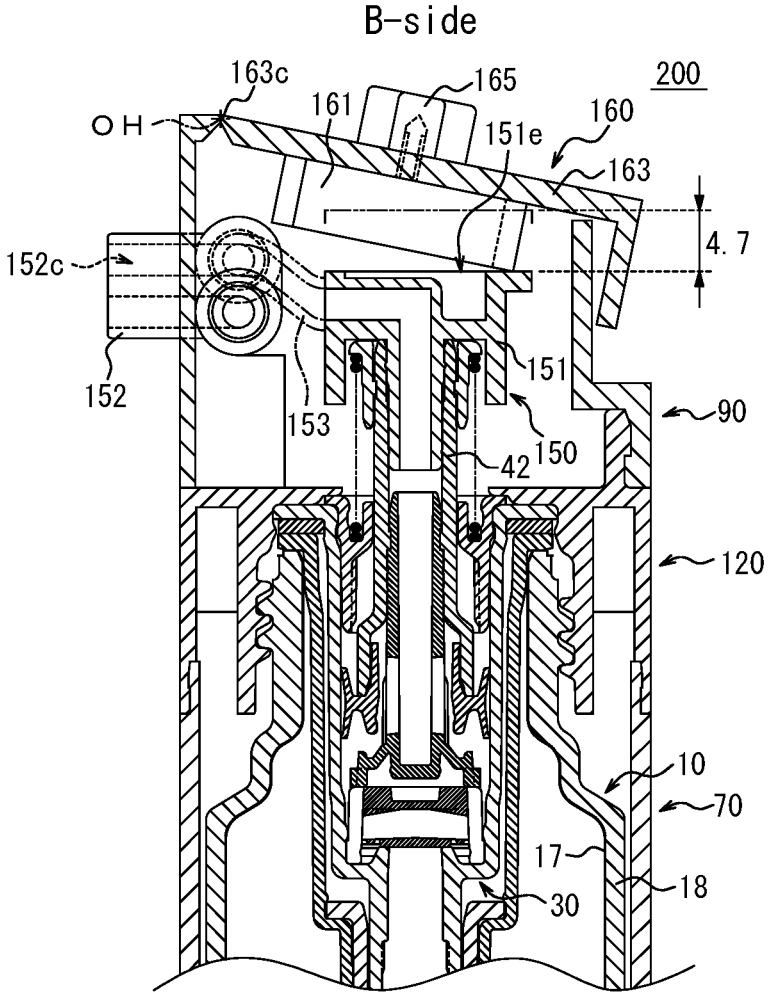
FIG. 17B is a right side sectional view illustrating the dispensing container in the state of FIG. 16 (from the side of container B)

By thus coupling the mounting member 151 and the dispensing port member 152 via the flexible tube 153, the flexible tube 153 can absorb relative height fluctuations between the mounting member 151 and the dispensing port member 152, so that the dispensing port member 152 can be maintained at the same position without tilting, even when, for example, the mounting member 151 is significantly displaced downward in response to a pressing head 163 being depressed as illustrated in FIG. 17B which will be described later.

Next, the head portion 160 will be described. The head portion 160 includes the adjusting member 161 that depresses the respective pressure-receiving portions 151*e* of the two mounting members 151 at a stroke ratio desired by the user, and the pressing head 163 through which pressing force is applied to the adjusting member 161.

Figure 14:
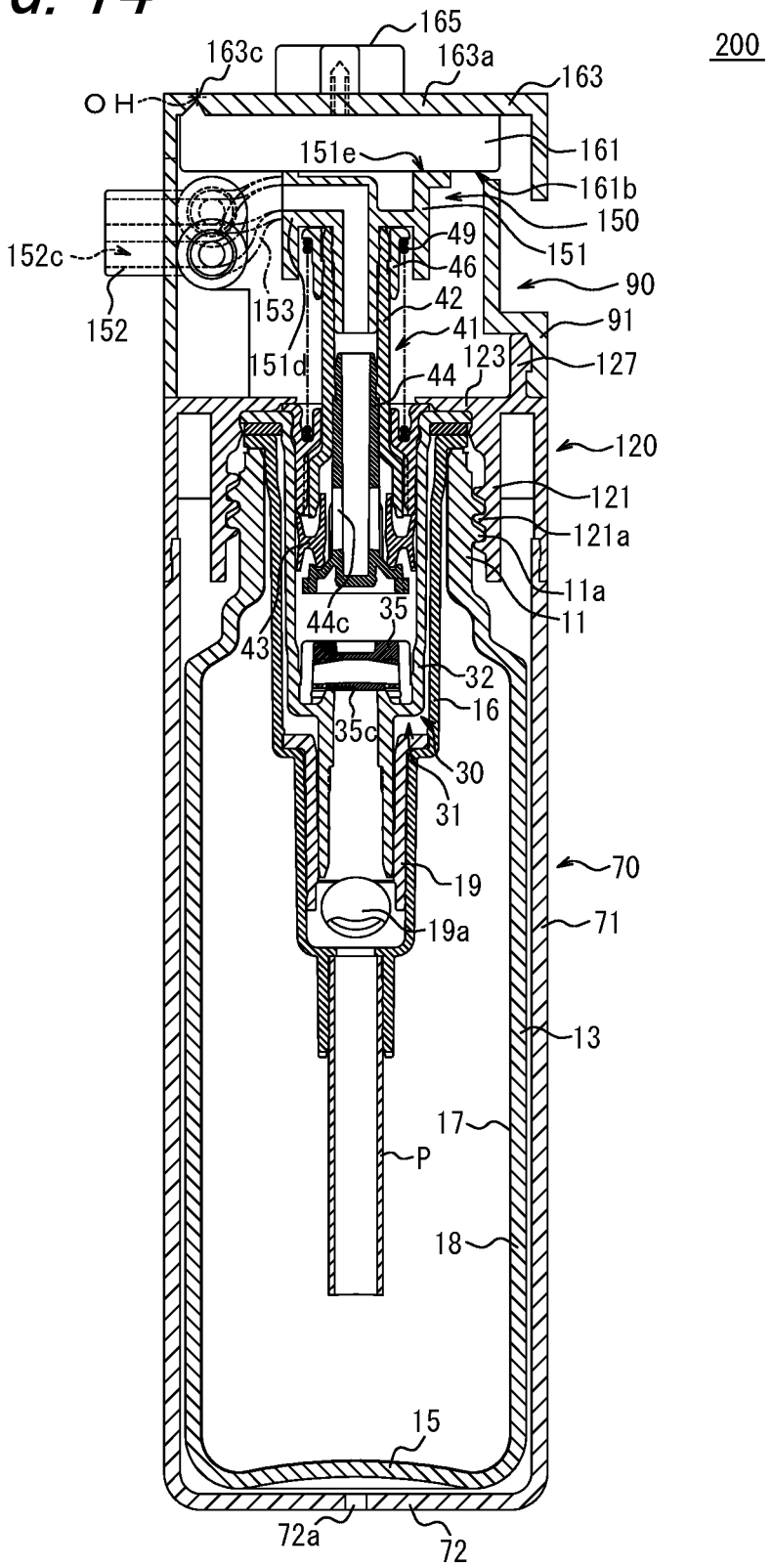
FIG. 14 is a right side sectional view illustrating the dispensing container of FIG. 12.
Figure 18:
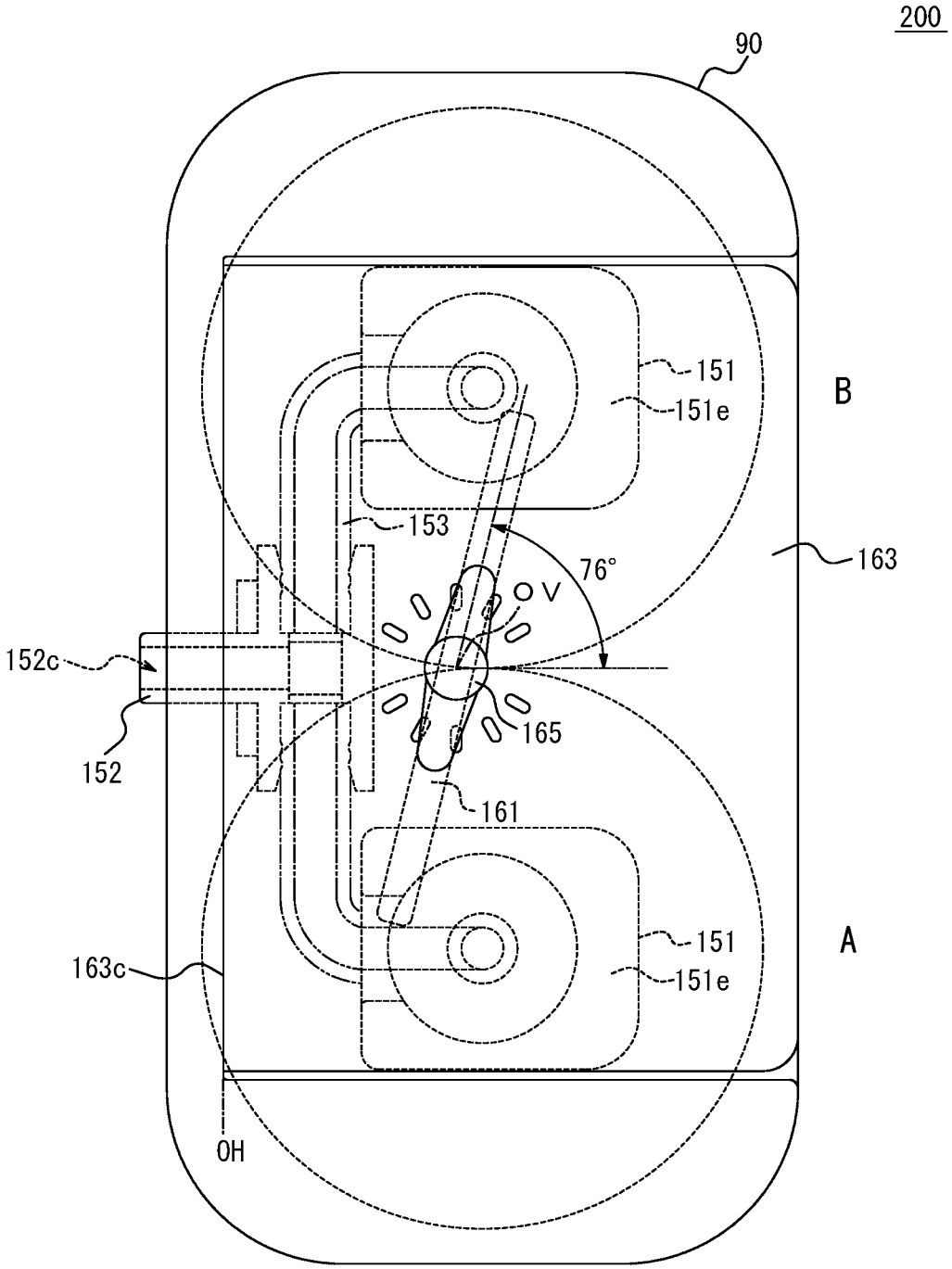
FIG. 18 is a plan view illustrating a state in which the ratio between two kinds of content liquids to be dispensed has been changed as a result of rotation of the adjusting member (tab) in FIG. 13B.
Figure 20:
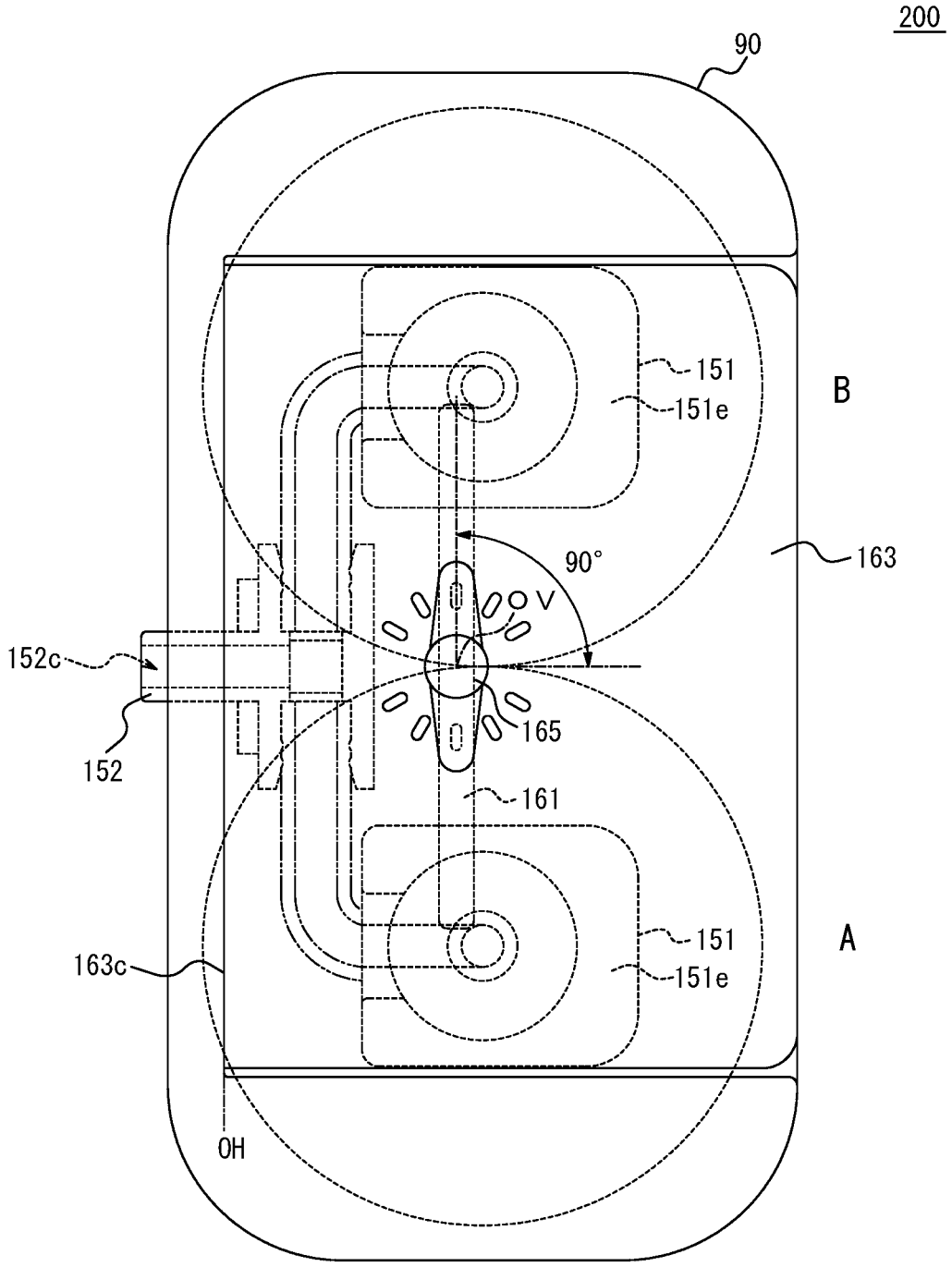
FIG. 20 is a plan view illustrating a state in which the amounts of the two kinds of content liquids to be dispensed have been made substantially equal as a result of rotation of the adjusting member (tab)

As illustrated in FIG. 13B and FIG. 14, the adjusting member 161 has a prismatic shape with a lower surface constituting pressing portions 161*b*. The adjusting member 161 includes a rotation shaft 161*d* that protrudes upward from its upper surface at the middle in its longitudinal direction, and the rotation shaft 161*d* protrudes upward through a rotation hole 163*b* formed in a pressing plate 163*a* of the pressing head 163 (refer to FIG. 12). The rotation shaft 161*d* is fitted to the tab 165 on an upper surface of the pressing plate 163*a*, and the adjusting member 161 is rotatable about the rotation shaft 161*d* (axis OV extending in the substantially vertical direction) by rotating the tab 165 in the circumferential direction. In the present embodiment, as illustrated in FIG. 18 and FIG. 20 which will be described later, the adjusting member 161 is configured to press the mounting member 151 at both two ends in the longitudinal direction of its lower surface. In this sense, the adjusting member 161 includes two pressing portions 161*b*.

As illustrated in FIG. 14, the pressing head 163 is integrally formed with the lid 90 and is configured to be rotatable about a hinge portion 163*c*. Thus, when the pressing plate 163*a* of the pressing head 163 is depressed, the pressing head 163 rotates about the hinge portion 163*c* (axis OH extending in the substantially horizontal direction). Accordingly, the greater a horizontal distance (distance in the left/right direction in FIG. 14) between a portion of a pressing portion 161*b* on the lower surface of the adjusting member 161 that actually presses the pressure-receiving portion 151*e* of the corresponding mounting member 151, the greater a stroke of the pressing portion 161*b* depressed by the pressing plate 163*a* becomes, provided that the pressing head 163 is rotated through the same angle. A stroke of the corresponding stem 42 depressed by the pressing portion 161*b* becomes greater accordingly. It is to be noted that FIG. 12 to FIG. 15 illustrate locked states in which, even when the pressing head 163 is depressed, the pressing head 163 and the adjusting member 161 do not come into abutment, thereby not depressing the stems 42.

Figure 16:
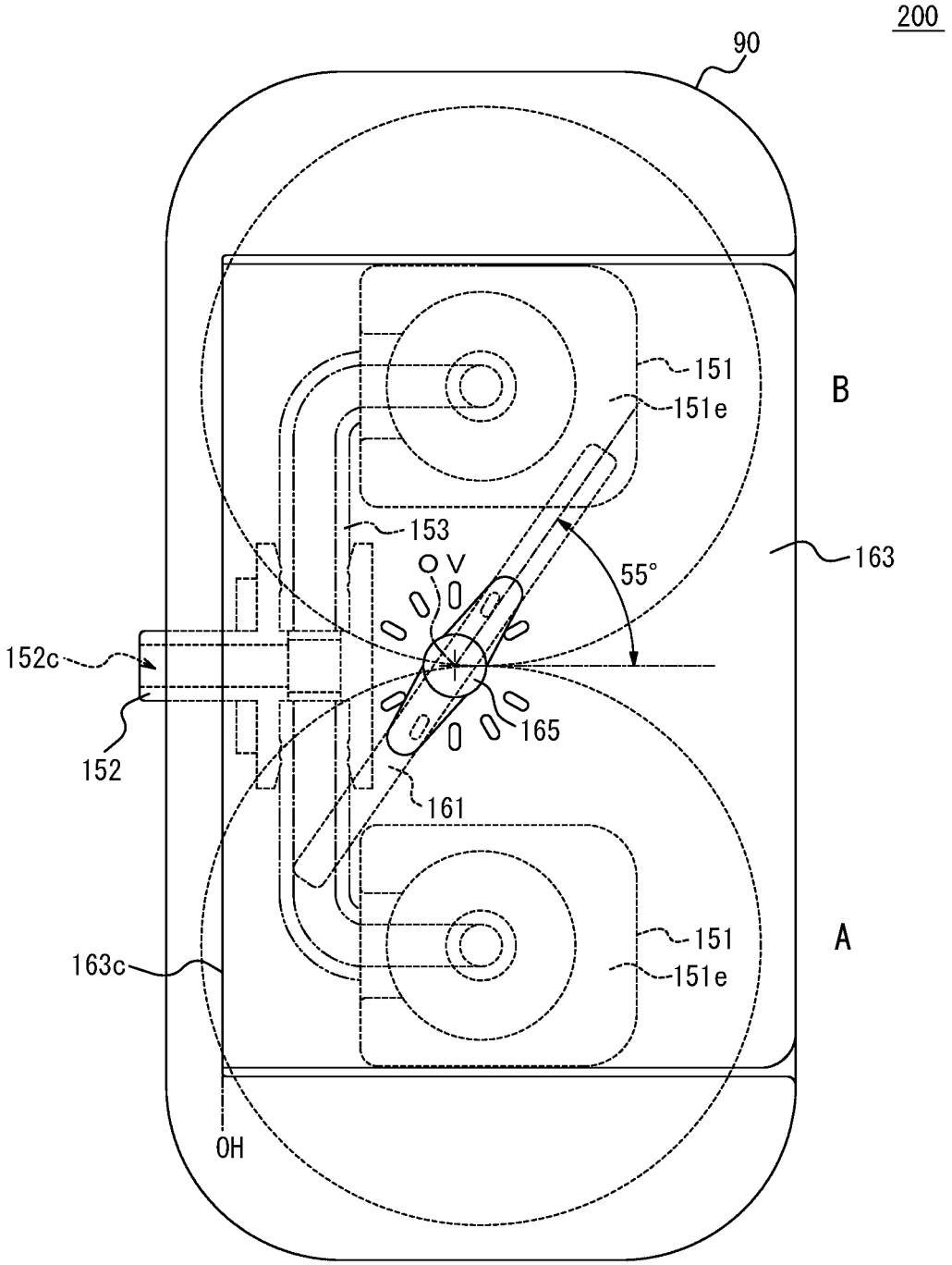
FIG. 16 is a plan view illustrating a state in which only one of content liquids can be dispensed as a result of rotation of an adjusting member (tab) in FIG. 13B.

FIG. 16 illustrates a state in which the tab 165 has been rotated counterclockwise by 55 degrees in the plan view from the locked state illustrated in FIG. 13B. As a result of the adjusting member 161 also being rotated in conjunction with the rotation of the tab 165, the adjusting member 161 and the mounting member 151 do not overlap at all on a side of container A located below in FIG. 16. On the other hand, on a side of container B located above in FIG. 16, the adjusting member 161 and the mounting member 151 are overlapped in the plan view and are therefore in a state in which the mounting member 151 can be pressed in response to pressing of the pressing head 163.

FIG. 17A and FIG. 17B are right side sectional views each illustrating the dispensing container 200 in the state of FIG. 16. FIG. 17A is a sectional view from the side of container A, illustrating that even when the pressing head 163 is pressed and rotated about the hinge portion 163*c* (axis OH extending in the substantially horizontal direction), the adjusting member 161 does not overlap with the mounting member 151 in the plan view, so that the mounting member 151 cannot pressed. It is therefore not possible to dispense the content on the side of container A. On the other hand, on the side of container B illustrated in FIG. 17B, when the pressing head 163 is pressed and rotated about the hinge portion 163*c* (axis OH extending in the substantially horizontal direction), the pressing portion 161*b* of the adjusting member 161 presses the mounting member 151, so that the stem 42 on the side of container B is also pressed. The content is therefore dispensed on the side of container B. Thus, when the adjusting member 161 is at the position illustrated in FIG. 16, FIG. 17A, and FIG. 17B, the ratio between the amounts of contents to be dispensed can be set to 0:100.

FIG. 18 illustrates a state in which the tab 165 has been rotated counterclockwise by 76 degrees in the plan view from the locked state illustrated in FIG. 13B. As a result of the adjusting member 161 also being rotated in conjunction with the rotation of the tab 165, the adjusting member 161 and the respective mounting members 151 are overlapped in the plan view both on the side of container A located below in FIG. 18 and on the side of container B located above in FIG. 18, thus being in a state in which both the mounting members 151 can be pressed in response to pressing of the pressing head 163.

Figure 19A:
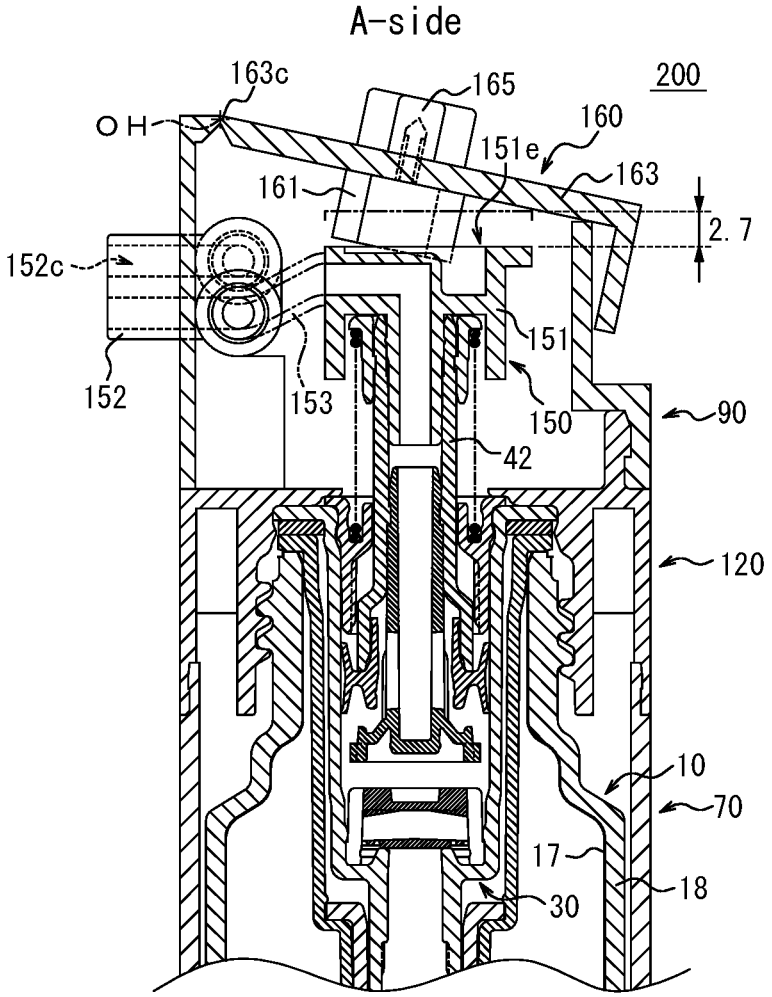
FIG. 19A is a right side sectional view illustrating the dispensing container in the state of FIG. 18 (from the side of container A)
Figure 19B:
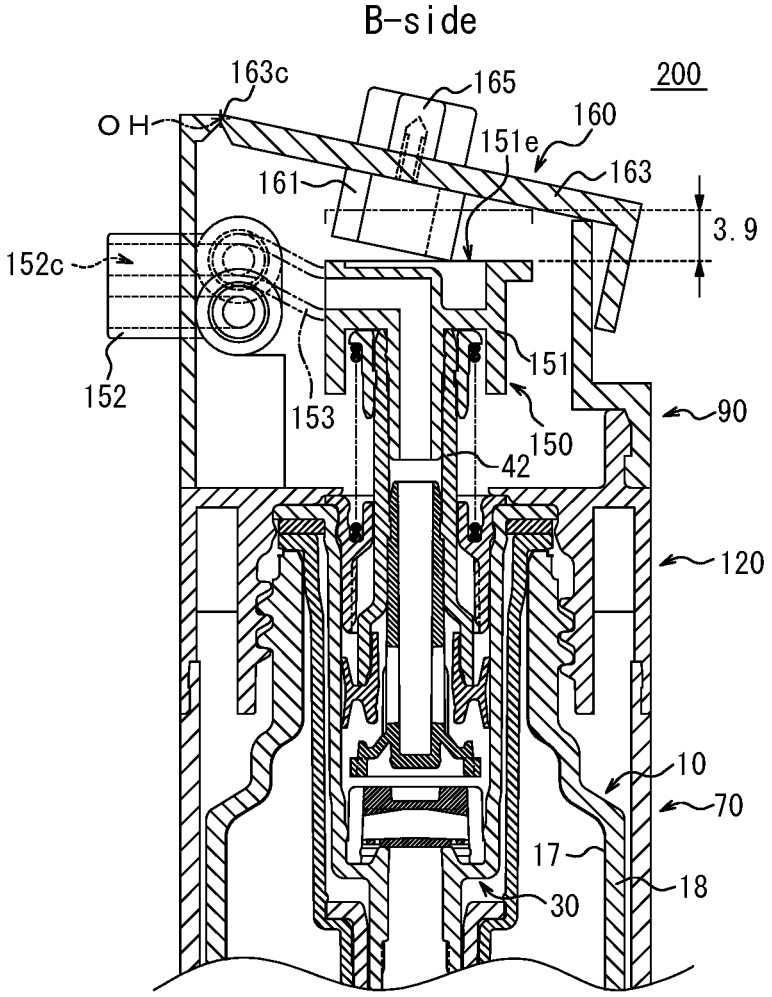
FIG. 19B is a right side sectional view illustrating the dispensing container in the state of FIG. 18 (from the side of container B)

As can be understood from FIG. 18, however, a distance from the hinge portion 163*c* (axis OH extending in the substantially horizontal direction) to a portion of the pressing portion 161*b* of the adjusting member 161 that overlaps with the pressure-receiving portion 151*e* of the mounting member 151 on the side of container A is smaller than that from the hinge portion 163*c* to a portion of the pressing portion 161*b* of the adjusting member 161 that overlaps with the pressure-receiving portion 151*e* of the mounting member 151 on the side of container B. Accordingly, when the pressing head 163 is pressed and rotated about the hinge portion 163*c* (axis OH extending in the substantially horizontal direction), a stroke length of the pressing head 163 pressing the mounting member 151 via the adjusting member 161 on the side of container A is 2.7 mm, and a stroke length of that on the side of container B is 3.9 mm. Thus, as can be understood from a comparison between FIG. 19A and FIG. 19B, the stroke length on the side of container A is smaller. Thus, the degree to which the stem 42 on the side of container A is depressed can be reduced compared with the degree to which the stem 42 on the side of container B is depressed, and therefore, the amount of the content to be dispensed on the side of container A can be reduced compared with the amount of the content to be dispensed on the side of container B. Additionally, the present applicants have conducted studies and found that the amount dispensed on the side of container A: the amount dispensed on the side of container B=30:70.

FIG. 20 illustrates a state in which the tab 165 has been rotated counterclockwise by 90 degrees in the plan view from the locked state illustrated in FIG. 13B. As a result of the adjusting member 161 also being rotated in conjunction with the rotation of the tab 165, the adjusting member 161 and the respective mounting members 151 are overlapped in the plan view by the same area both on the side of container A located below in FIG. 20 and on the side of container B located above in FIG. 20, thus being in a state in which both the mounting members 151 can be pressed in response to pressing of the pressing head 163.

Figure 21A:
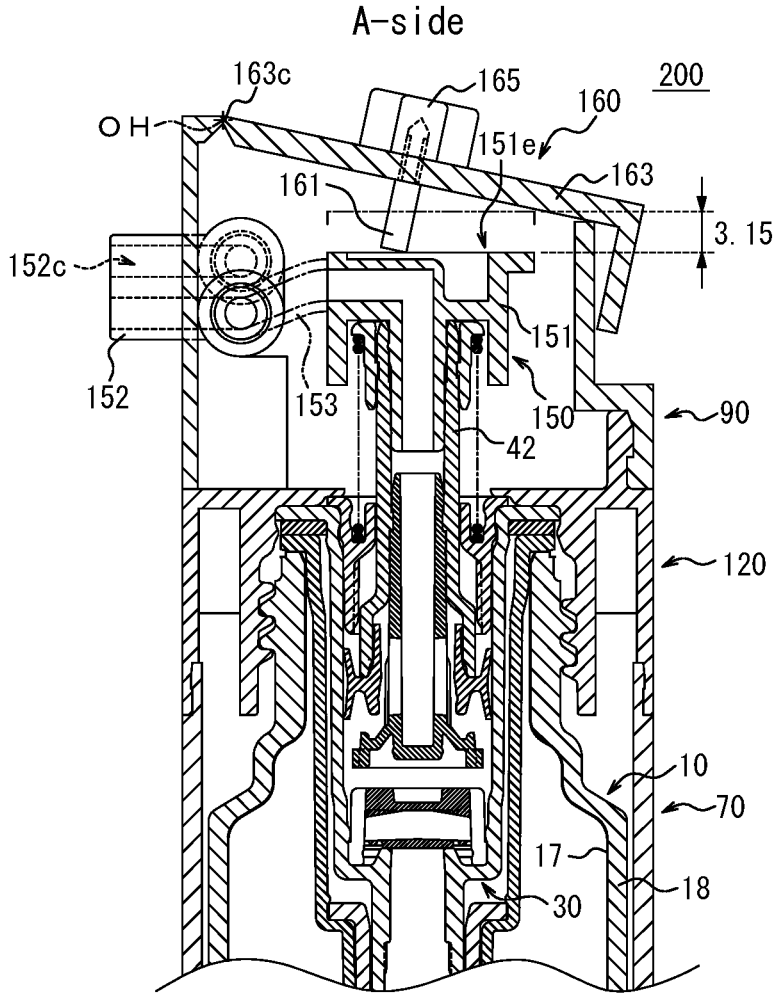
FIG. 21A is a right side sectional view illustrating the dispensing container in the state of FIG. 20 (from the side of container A)
Figure 21B:
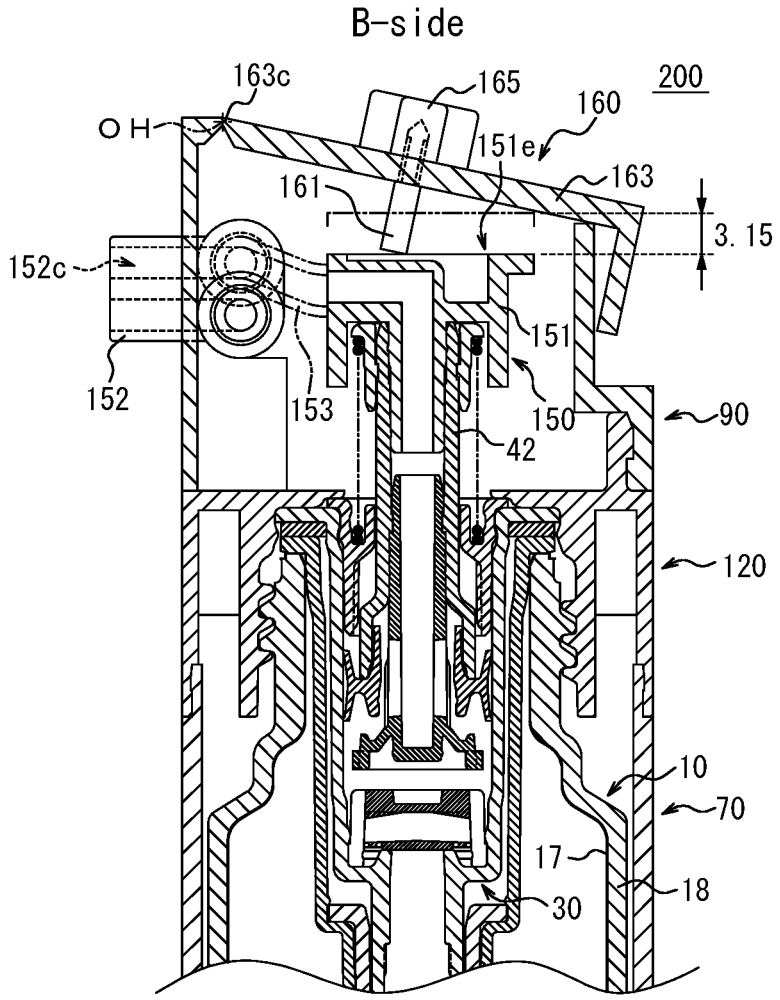
FIG. 21B is a right side sectional view illustrating the dispensing container in the state of FIG. 20 (from the side of container B)

Moreover, a distance from the hinge portion 163*c* (axis OH extending in the substantially horizontal direction) to a portion of the pressing portion 161*b* of the adjusting member 161 on the side of container A that overlaps with the pressure-receiving portion 151*e* of the mounting member 151 is the same as that from the hinge portion 163*c* to a portion of the pressing portion 161*b* of the adjusting member 161 on the side of container B that overlaps with the pressure-receiving portion 151*e* of the mounting member 151. Accordingly, when the pressing head 163 is pressed and rotated about the hinge portion 163*c* (axis OH extending in the substantially horizontal direction), a stroke length of the pressing head 163 pressing the mounting member 151 via the adjusting member 161 on the side of container A is 3.15 mm, and a stroke length of that on the side of container B is equally 3.15 mm, as can be understood from a comparison between FIG. 21A and FIG. 21B. Thus, the degree of pressing of the stem 42 on the side of container A can be made substantially equal to the degree of pressing of the stem 42 on the side of container B, and therefore, the amount of the content to be dispensed on the side of container A can be made substantially equal to the amount of the content to be dispensed on the side of container B.

As described above, in the present embodiment, the adjusting member 161 is configured to be coupled to the tab 165, which is provided on the upper surface of the pressing head 163, so that rotation of the adjusting member 161 can be adjusted by rotating the tab 165. By adopting such a configuration, the adjusting member 161, which is disposed between the pressing head 163 and the mounting members 151, can be adjusted by a simple operation of rotating the tab 165 provided on the pressing head 163.

Further, in the present embodiment, each nozzle portion 150 is configured to be coupled to the corresponding dispensing port 152*c* via the corresponding flexible tube 153. By adopting such a configuration, the flexible tube 153 can absorb relative height fluctuations between the mounting member 151 and the dispensing port 152*c* (dispensing port member 152), so that the dispensing port 152*c* can be maintained at the same position without tilting, even when the nozzle portion 150 (mounting member 151) is significantly displaced downward in response to the pressing head 163 being depressed.

In the following, a dispensing container 300 according to a third embodiment of the present disclosure will be described by illustration in detail with reference to the drawings.

It is to be noted that, compared with the first embodiment, the dispensing container 300 according to the third embodiment is similar to the first embodiment, except for the following points: the functions of the dispensing caps 20 and the coupling member 80 are realized by a dispensing cap 220 alone; the functions of the adjusting member 61 and the operation lever 61*f* in the head portion 60 are realized by an adjusting member 261 and an operation portion 261*f* in a head portion 260; and the outer container 70 is not additionally provided around the container bodies 10. The description herein will therefore focus on the points different from the first embodiment.

Figure 24:
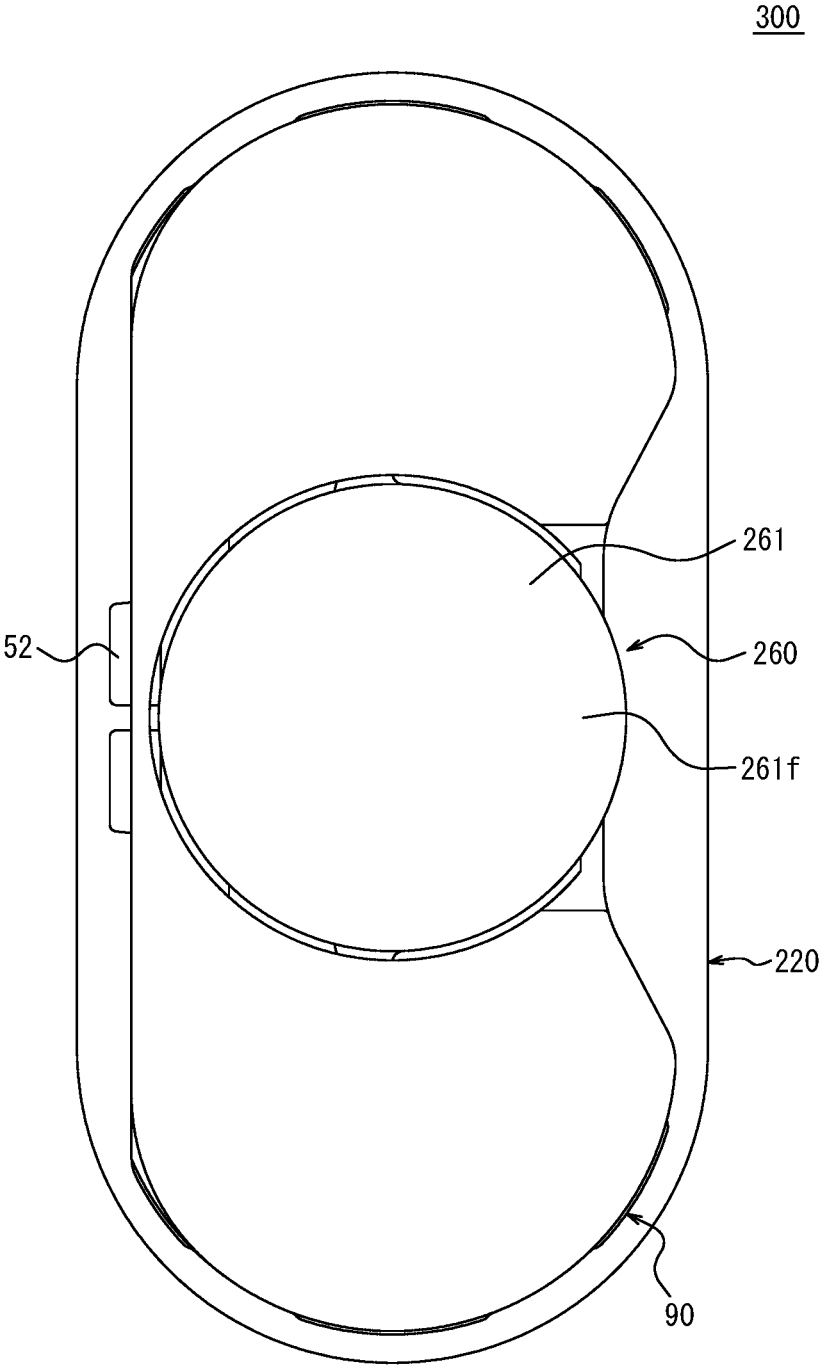
FIG. 24 is a plan view illustrating the dispensing container of FIG. 22.

The dispensing cap 220 of the present embodiment is made of polypropylene and has a rectangular shape with rounded corners in the plan view (refer to FIG. 24). The dispensing cap 220 includes two circumferential walls 221 that are respectively mounted to the mouths 11 of the two container bodies 10, a top wall 223 that is contiguous with upper end portions of the circumferential walls 221, an upper circumferential wall 227 that extends further upward from an upper surface of the top wall 223, and an engagement protrusion 227*a* that extends to the outer side in the radial direction from the upper circumferential wall 227 and that is used to mount the lid 90 thereon by engaging with an inner circumferential surface of a lower portion of the outer circumferential wall 91 in the lid 90. The dispensing cap 220 is mounted to the container bodies 10 so that the circumferential walls 221 cover the mouths 11 from the outer side in the radial direction and that the top wall 223 covers the mouths 11 from above. Additionally, the dispensing cap 220 may be formed from other resins, such as polyethylene.

Each circumferential wall 221 is provided, on an inner circumferential surface thereof, with a female screw portion 221*a*. The female screw portion 221*a* protrudes to the inner side in the radial direction from the inner circumferential surface of the circumferential wall 221, and the female screw portion 221*a* is configured to be screw-engaged with the male screw portion 11*a*.

Figure 22:
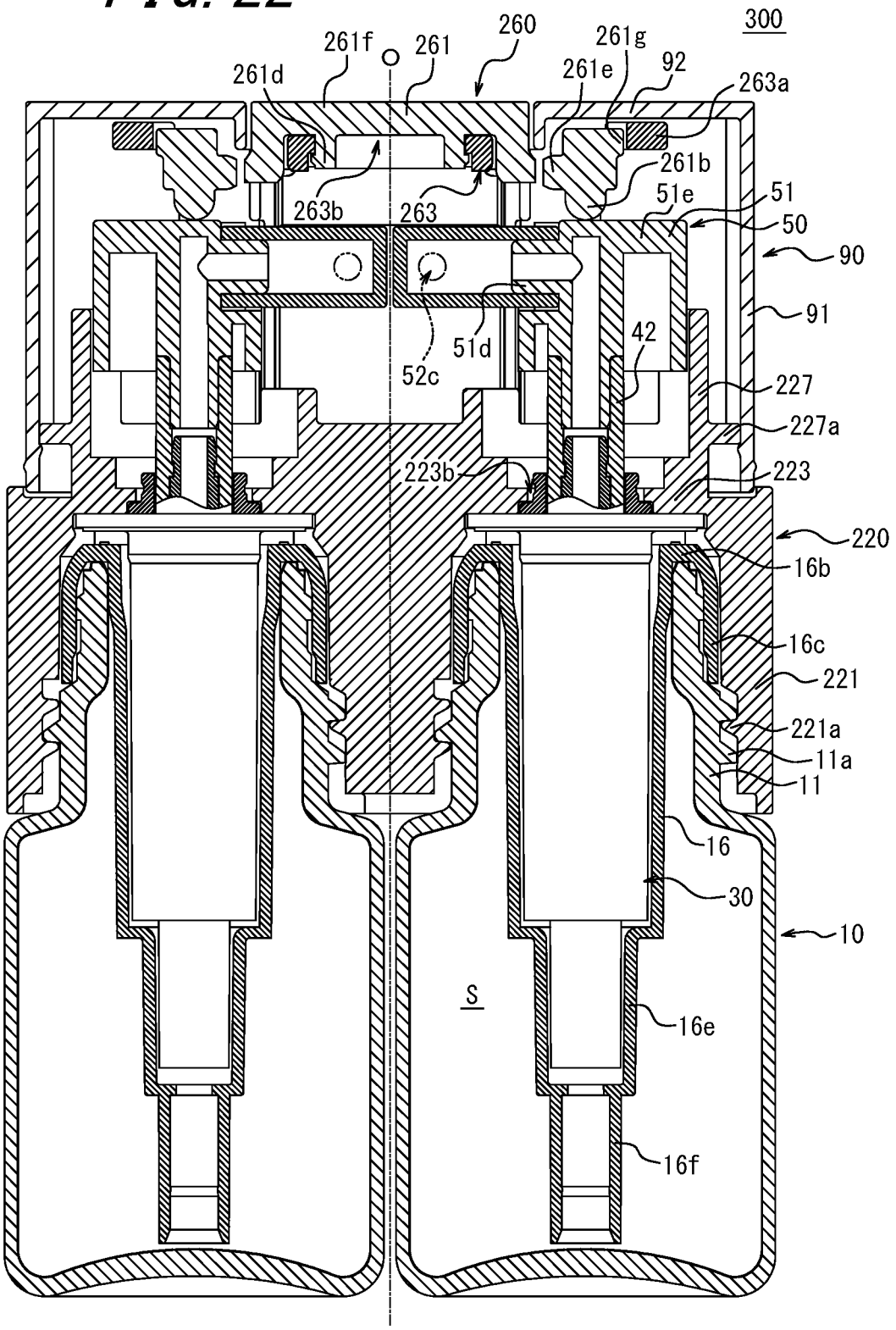
FIG. 22 is a front sectional view illustrating a dispensing container according to a third embodiment of the present disclosure.
Figure 23:
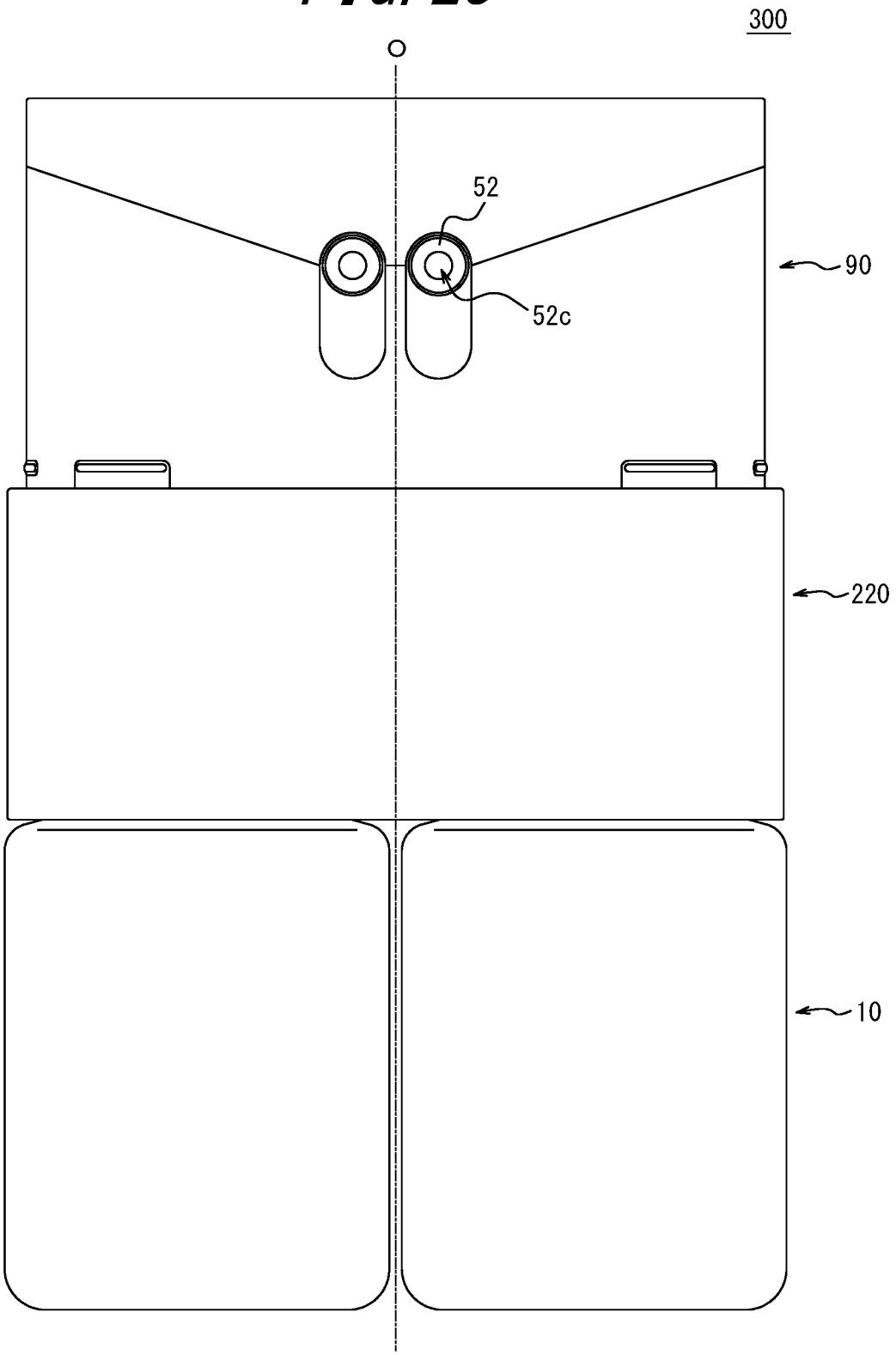
FIG. 23 is a front view illustrating the dispensing container of FIG. 22.

The top wall 223 of the dispensing cap 220 is provided with two communication holes 223*b*. As illustrated in FIG. 22, upper portions of the pumps 30 extend vertically through the communication holes 223*b*, so as to convey pressing force from the head portion 260 to the pumps 30.

Next, the head portion 260 will be explained. The head portion 260 includes an adjusting member 261 that depresses the respective pressure-receiving portions 51*e* of the two mounting members 51 of the two nozzle portions 50 at a stroke ratio desired by the user, and a pressing head 263 that can rotate about the axis OH extending in the substantially horizontal direction that is parallel to a direction in which the two container bodies 10 are arranged (refer to FIG. 25), to thereby depress the two stems 42 via the adjusting member 261.

In the present embodiment, the pressing head 263 is configured to be depressed in response to the operating portion 261*f* of the adjusting member 261 being pressed downward. In this way, a depressing operation of the pressing head 263 refers to a notion including a case of indirectly depressing the pressing head 263 by applying force to another member as in the present embodiment, without being limited to a case of directly depressing the pressing head 263.

Figure 25:
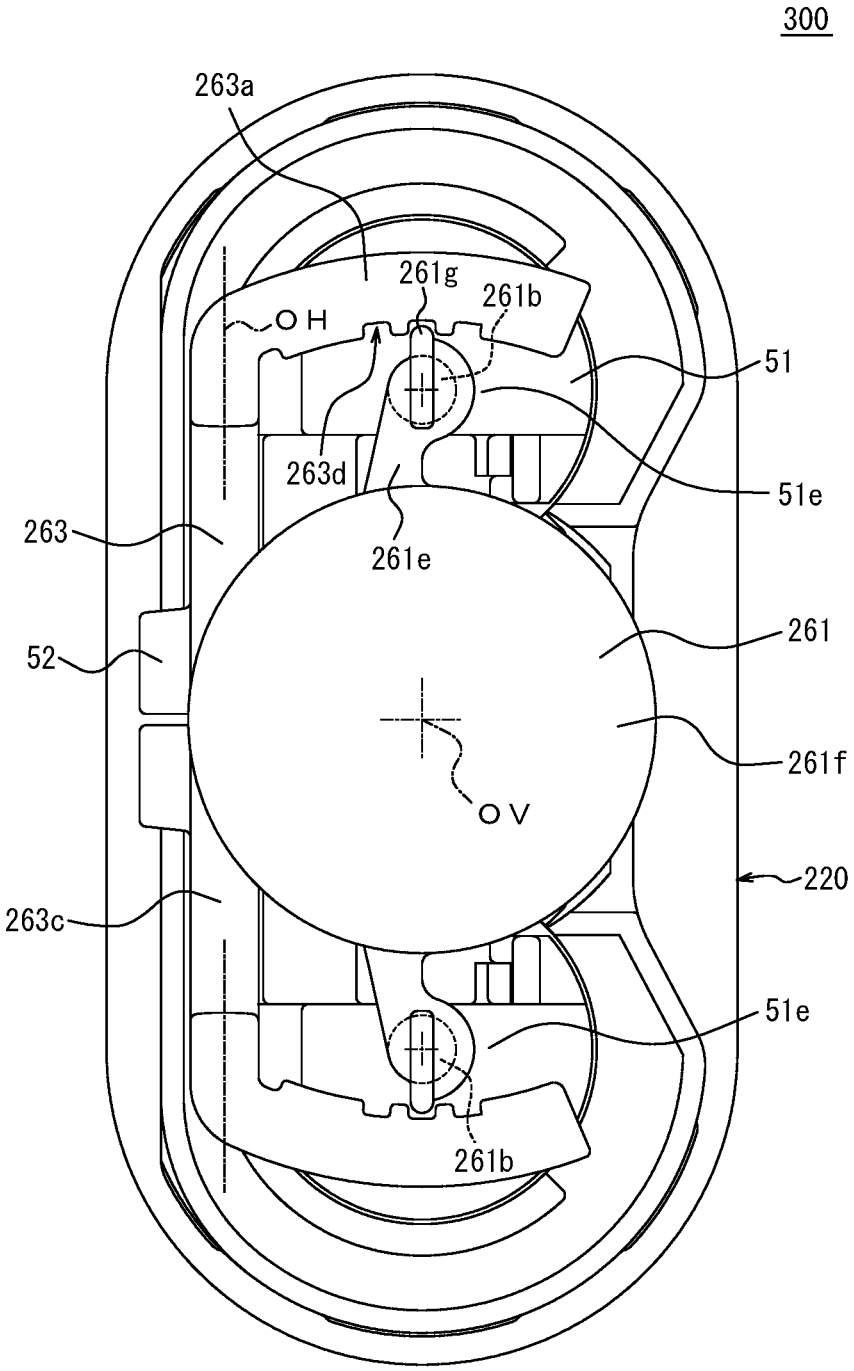
FIG. 25 is a plan view illustrating the dispensing container of FIG. 22 excluding an upper wall of a lid.

As illustrated in FIG. 25, the adjusting member 261 includes an portion 261*e* that extends in the left/right direction (left/right direction in FIG. 22, which corresponds to the up/down direction in FIG. 25), pressing portions 261*b* that are formed on lower surfaces of both end portions in the longitudinal direction of the arm portion 261*e*, fitting protrusions 261*g* that protrude from upper portions of the pressing portions 261*b* in the left/right direction (up/down direction in FIG. 25), and a disk-shaped operation portion 261*f* provided at the middle in the longitudinal direction of the adjusting member 261. As illustrated in FIG. 22, the adjusting member 261 is mounted to the pressing head 263 by fitting a rotation shaft 261*d* of the adjusting member 261 to a rotation hole 263*b* provided in the pressing head 263, and the adjusting member 261 is rotatable about the rotation hole 263*b* (axis OV extending in the substantially vertical direction) (refer to FIG. 25).

The pressing head 263 includes a rotation shaft 263*c* defining the axis OH extending in the substantially horizontal direction, positioning arms 263*a* that extend rearward from both end portions in the left/right direction (up/down direction in FIG. 25) of the rotation shaft 263*c*, and the aforementioned rotation hole 263*b*.

The rotation shaft 263*c* of the pressing head 263 is configured to be rotatable around a sliding surface (which is not shown) provided in the lid 90. Thus, when the pressing head 263 is depressed in the direction toward the back of the plane of paper in FIG. 25 via the operation portion 261*f*, the pressing head 263 rotates about the rotation shaft 263*c* (axis OH extending in the substantially horizontal direction). Accordingly, the greater a distance (distance in the left/right direction FIG. 25) between the rotation shaft 263*c* (axis OH extending in the substantially horizontal direction) and a pressing portion 261*b* in the plan view, the greater a stroke of the pressing portion 261*b* that is depressed becomes, provided that the pressing head 263 is rotated through the same angle. A stroke of the corresponding stem 42 depressed by the pressing portion 261*b* becomes greater accordingly. It is therefore possible to relatively increase the amount of the content to be dispensed by the stem 42 (pump 30) depressed by one of the pressing portions 261*b* that is at a greater distance from the axis OH extending in the substantially horizontal direction, by rotating the adjusting member 261 about the axis OV extending in the substantially vertical direction to thereby make respective distances (distances in the left/right direction in FIG. 25) from the axis OH extending in the substantially horizontal direction to the two pressing portions 261*b* different from each other in FIG. 25. Thus, the ratio between the two kinds of contents to be dispensed can be changed.

In the present embodiment, rotation of the adjusting member 261 about the axis OV extending in the substantially vertical direction can be adjusted by rotating the operation portion 261*f* illustrated in FIG. 22 and FIG. 25 about the axis OV extending in the substantially vertical direction. By doing so, the arm portion 261*e* of the adjusting member 261 and the pressing portions 261*b*, which are provided at the ends of the arm portion 261*e*, rotate about the axis OV extending in the substantially vertical direction, and respective distances (distances in the left/right direction in FIG. 25) from the axis OH extending in the substantially horizontal direction to the two pressing portions 261*b* can be changed.

It is to be noted that in the present embodiment an angular position of the adjusting member 261 about the axis OV extending in the substantially vertical direction with respect to the pressing head 263 is determined, by fitting the plurality of fitting protrusions 261*g*, which are provided on the upper portions of the pressing portions 261*b*, in a plurality of recesses 263*d* provided in the corresponding positioning arm 263*a* of the pressing head 263. The user can change the angular position of the adjusting member 261 about the axis OV extending in the substantially vertical direction with respect to the pressing head 263, by further rotating the operating portion 261*f* about the axis OV extending in the substantially vertical direction to thereby fit the fitting protrusions 261*g* in different recesses 263*d*. Thus, the ratio of the two kinds of contents to be dispensed can be changed.

With the above configuration in which the fitting protrusions 261*g* are fitted in the recesses 263*d*, the user can easily see that the adjusting member 261 has been adjusted to an intended angular position. Further, the adjusting member 261 is prevented from shifting out of the angular position contrary to the intention of the user.

While the present disclosure has been described with reference to the drawings and examples, it is to be noted that various modifications and revisions may be implemented by those skilled in the art based on the present disclosure. Therefore, such changes and modifications are to be understood as included within the scope of this disclosure. For example, functions or the like included in each component can be rearranged without logical inconsistency, and a plurality of components can be combined together or divided. These are construed as being encompassed in the scope of the present disclosure.

For example, although in the first through the third embodiment, the container bodies 10 are laminated peelable containers (double containers), the present disclosure is not limited to these embodiments, and the container bodies 10 do not necessarily need to have double container configurations. For example, as the container bodies 10, high viscosity pump dispenser (HVD) containers having bottom portions provided with middle plates may be employed in place of double containers.

Further, although in the first through the third embodiment the adjusting members 61, 161, 261 are configured to indirectly press the stems 42 via the nozzle portions 50, 150 (mounting members 51, 151), the present disclosure is not limited to these embodiments, and the adjusting members 61, 161, 261 may be configured to directly press the stems 42.

Moreover, although in the first through the third embodiment the dispensing caps 20, 120, 220 are made of polypropylene or polyethylene, the present disclosure is not limited to these embodiments, and the dispensing caps 20, 120, 220 may be made of other synthetic resin materials.

Moreover, although in the first through the third embodiment the outer layer body 18 of each container body 10 is made of polyethylene resin or polyethylene terephthalate, the present disclosure is not limited to these embodiments, and it is only necessary that the outer layer body 18 and the inner layer body 17 have low compatibility with each other, and a material for the outer layer body 18 and a material for the inner layer body 17 can be changed in various ways.

Moreover, although in the first through the third embodiment the container bodies 10 are configured to be formed by extrusion blow molding, the present disclosure is not limited to these embodiments, and the container bodies 10 may be formed by biaxial stretch blow molding.

Moreover, each nozzle portion 50 in the first embodiment is configured to be provided, in the upper end portion thereof on the side adjacent to the axis OH extending in the substantially horizontal direction in the plan view, with the recess 51*f* that is recessed downward. In the second and the third embodiment also, recesses may be formed in upper end portions on the side adjacent to the axis OH extending in the substantially horizontal direction in the plan views.

Further, although the pipe P are fitted inside the second reduced-diameter portions 16*f* of the containing tubular portions 16 only in the second embodiment, pipes P may be provided in the dispensing containers 100, 300 according to the first and the third embodiment. In a case in which the container bodies 10 are double containers or HVD containers, pipes P are not essential components and may or may not be provided. In a case in which the container bodies 10 are normal containers that are neither double containers nor HVD containers, pipes P are preferably provided, although this is not essential.

In the first and the second embodiment, the pressing heads 63, 163 are configured to cover the adjusting members 61, 161 from above, the present disclosure is not limited to these embodiments. For example, the adjusting members 61, 161 may be mounted on upper surfaces of the pressing heads 63, 163 so as to be relatively rotatable, and the pressing portions 61*b*, 161*b* of the adjusting members 61, 161 may be configured to extend downward through openings provided in the pressing heads 63, 163 so as to be capable of pressing the mounting members 51, 151 or the like.

Further, although in the first through the third embodiment each of the adjusting members 61, 161, 261 is configured to press each stem 42 by the corresponding pressing portion 61*b*, 161*b*, 261*b* via the corresponding mounting member 51, 151, the present disclosure is not limited to these embodiments. The adjusting members 61, 161, 261 may be configured so that each stem 42 is pressed by a plurality of pressing portions 61*b*, 161*b*, 261*b*.

REFERENCE SIGNS LIST

10 Container body
11 Mouth
11*a* Male screw portion
12 Shoulder
13 Trunk
14 Reduced-diameter portion
15 Bottom
16 Containing tubular portion
16*a* Tubular portion
16*b* Flange portion
16*c* Upper outer wall
16*d* Stepped portion
16*e* First reduced-diameter portion
16*f* Second reduced-diameter portion
17 Inner layer body
18 Outer layer body
19 Inner plug member
19*a* Inner plug
19*b* Circumferential wall
20 Dispensing cap
21 Outer circumferential wall
21*a* Female screw portion
22 Upper circumferential wall
22*a* Stepped portion
22*b* Outer circumferential rib
23 Top wall
23*a* Fitting tube
23*b* Communication hole
30 Pump
31 Lower assembly
33 Cylinder
33*a* Tubular-shaped portion
33*b* Flange portion
33*c* Stepped portion
33*d* Fitting tube
33*e* Draw valve seat
34 Second locking member
35 Draw valve member
35*a* Support frame
35*b* Upper wall
35*c* Draw valve
35*d* Support member
41 Upper assembly
42 Stem
42*a* Coupling tubular portion
42*b* Stepped portion
42*c* Large-diameter portion
43 Annular piston
43*a* Outer wall
43*b* Inner wall upper end portion
43*c* Inner wall lower end portion
44 Piston guide
44*a* Guide body
44*c* Discharge valve hole
44*d* Discharge valve seat
44*e* Lower end portion
46 First locking member
49 Urging spring

50 Nozzle portion
51 Mounting member
51*a* Perpendicular tubular portion
51*b* Ceiling wall
51*c* Circumferential wall
51*d* Horizontal tubular portion
51*e* Pressure-receiving portion
51*f* Recess
52 Dispensing port member
52*a* Fitting tubular portion
52*b* Dispensing port tubular portion
52*c* Dispensing port
60 Head portion
61 Adjusting member
61*b* Pressing portion
61*d* Rotating hole
61*e* Arm portion
61*f* Operation lever
61*g* Abutment portion
63 Pressing head
63*a* Pressing plate
63*b* Rotation shaft
63*c* Rotation shaft
63*h* Through hole
70 Outer container
71 Side wall portion
72 Bottom portion
73 Positioning wall
80 Coupling member
82 Upper wall
83 Upper tubular wall
84 Side wall portion
84*a* Inner rib
85 Partition wall
90 Lid
91 Outer circumferential wall
92 Upper wall
100, 200, 300 Dispensing container
120 Dispensing cap
121 Inner circumferential wall
121*a* Female screw portion
123 Top wall
123*b* Communication hole
125 Outer circumferential wall
127 Upper circumferential wall
150 Nozzle portion
151 Mounting member
151*a* Vertical tubular portion
151*d* Horizontal tubular portion
151*e* Pressure-receiving portion
152 Dispensing port member
152*a* Fitting tubular portion
152*b* Dispensing port tubular portion
152*c* Dispensing port
153 Flexible tube
160 Head portion
161 Adjusting member
161*b* Pressing portion
161*d* Rotation shaft
163 Pressing head
163*a* Pressing plate
163*b* Rotating hole
163*c* Hinge portion
165 Tab
220 Dispensing cap
221 Circumferential wall
221*a* Female screw portion
223 Top wall
223*b* Communication hole
227 Upper circumferential wall
227*a* Engagement protrusion
260 Head portion
261 Adjusting member
261*b* Pressing portion
261*d* Rotation shaft
261*e* Arm portion
261*f* Operation portion
261*g* Fitting protrusion
263 Pressing head
263*a* Positioning arm
263*b* Rotating hole
263*c* Rotation shaft
263*d* Recess
O Axis
OH Axis extending in substantially horizontal direction
OV Axis extending in substantially vertical direction
S Containing space

The invention claimed is:

1. A dispensing container comprising:

two container bodies configured to respectively contain two kinds of contents;

two pumps respectively including two protruding stems configured to be depressed in an upwardly urged state, the two pumps being configured to respectively pump the two kinds of contents in the two container bodies upward in response to the two stems being depressed;

an adjusting member configured to directly or indirectly press the two stems and configured to be rotatable about an axis extending in a vertical direction that is located between the two container bodies in a plan view; and a pressing head configured to, in response to a depressing operation, rotate about an axis extending in a horizontal direction that is parallel to a direction in which the two container bodies are arranged, to thereby depress the two stems via the adjusting member, wherein:

the adjusting member includes a plurality of pressing portions by which the two stems are directly or indirectly pressed, and when the adjusting member is rotated about the axis extending in the vertical direction, one of the plurality of pressing portions on a side of one of the two stems approaches the axis extending in the horizontal direction in the plan view, whereby a depressing stroke of the one of the plurality of pressing portions on the side of the one of the two stems becomes shorter in response to a depressing operation of the pressing head, and another one of the plurality of pressing portions on a side of another one of the two stems moves away from the axis extending in the horizontal direction, whereby a depressing stroke of the other one of the plurality of pressing portions on the side of the other one of the two stems becomes longer in response to the depressing operation of the pressing head.

2. The dispensing container according to claim 1, wherein the plurality of pressing portions of the adjusting member is configured to protrude downward from both end portions of an arm portion extending in the horizontal direction, and the adjusting member is configured to be mounted to the pressing head so as to be rotatable about the axis extending in the vertical direction.

3. The dispensing container according to claim 2, wherein the adjusting member includes an operation lever that is orthogonal to a longitudinal direction of the arm portion and that protrudes to a side opposite to the axis extending in the horizontal direction in the plan view, and the operation lever is configured to protrude in the horizontal direction through a through hole provided in the pressing head.

4. The dispensing container according to claim 1, wherein the adjusting member is configured to be coupled to a tab provided on an upper surface of the pressing head, so that rotation of the adjusting member is adjustable by rotating the tab.

5. The dispensing container according to claim 1, wherein two nozzle portions are respectively mounted to the two stems, the two nozzle portions being configured to respectively guide the two kinds of contents pumped from the two pumps to two dispensing ports, and the adjusting member is configured to press the two stems via the two nozzle portions.

6. The dispensing container according to claim 5, wherein each of the two the nozzle portions is configured to be provided with a recess that is recessed downward, each recess being provided in an upper end portion of each of the two nozzle portions on a side adjacent to the axis extending in the horizontal direction in the plan view.

7. The dispensing container according to claim 5, wherein each of the two nozzle portions is configured to be coupled to the corresponding dispensing port via a flexible tube.

* * * * *